US010276105B2

(12) United States Patent
Ma et al.

(10) Patent No.: US 10,276,105 B2
(45) Date of Patent: Apr. 30, 2019

(54) REVERSIBLE BIAS ORGANIC LIGHT-EMITTING DIODE (OLED) DRIVE CIRCUIT WITHOUT INITIALIZATION VOLTAGE

(71) Applicant: QUALCOMM Incorporated, San Diego, CA (US)

(72) Inventors: Jia Wei Ma, Jiangs (CN); Heesun Shin, San Diego, CA (US); Wei Hsiang Weng, Hsin-Chu (TW); Cheonhong Kim, San Diego, CA (US); Jan Bos, Hsinchu (TW)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/616,630

(22) Filed: Jun. 7, 2017

(65) Prior Publication Data

US 2018/0357966 A1 Dec. 13, 2018

(51) Int. Cl.

| | |
|---|---|
| ***G09G 3/3291*** | (2016.01) |
| ***G09G 3/3266*** | (2016.01) |
| ***G09G 3/3233*** | (2016.01) |
| ***G09G 3/3258*** | (2016.01) |

(52) U.S. Cl.

CPC ..... *G09G 3/3291* (2013.01); *G09G 3/3233* (2013.01); *G09G 3/3258* (2013.01); *G09G 3/3266* (2013.01); *G09G 2300/0426* (2013.01); *G09G 2300/0465* (2013.01); *G09G 2300/0814* (2013.01); *G09G 2300/0819* (2013.01); *G09G 2300/0823* (2013.01);

(Continued)

(58) Field of Classification Search

CPC ..... G09G 3/22; G09G 3/3208; G09G 3/30; G09G 3/3225; G09G 3/3233; G09G 3/3241; G09G 3/3266; G09G 3/3275; G09G 3/3258

See application file for complete search history.

(56) References Cited

U.S. PATENT DOCUMENTS

| | | | |
|---|---|---|---|
| 7,557,784 | B2 | 7/2009 | Kwak et al. |
| 8,237,637 | B2 | 8/2012 | Chung |
| 8,698,854 | B2 | 4/2014 | Lee |

(Continued)

OTHER PUBLICATIONS

International Search Report and Written Opinion—PCT/US2018/026312—ISA/EPO—Jun. 25, 2018.

*Primary Examiner* — William Lu

(74) *Attorney, Agent, or Firm* — Knobbe, Martens, Olson & Bear, LLP

(57) ABSTRACT

This disclosure provides systems, methods and apparatus for OLED control circuits. In some implementations, the OLED control circuit can be configured to reverse the bias of the OLED without the use of a dedicated initialization voltage. A low voltage data signal applied on a data line can be used to drain voltage from the anode of the OLED through a diode-connected transistor. A high voltage data signal applied on the same data line can be used to store a reference voltage on a storage capacitor, where the reference voltage is also a function of the threshold voltage of a driving transistor of the OLED control circuit. The stored reference voltage can be used to compensate for the threshold voltage of the driving transistor when the OLED is energized by a current, so that the current is independent of the threshold voltage of the driving transistor.

19 Claims, 32 Drawing Sheets

(52) U.S. Cl.
CPC ..... *G09G 2300/0842* (2013.01); *G09G 2300/0861* (2013.01); *G09G 2320/043* (2013.01); *G09G 2320/045* (2013.01)

(56) References Cited

U.S. PATENT DOCUMENTS

| | | | | |
|---|---|---|---|---|
| 8,749,598 | B2 | 6/2014 | Taro et al. | |
| 9,196,192 | B2 * | 11/2015 | Kim | G09G 3/3208 |
| 9,286,831 | B2 | 3/2016 | Qing et al. | |
| 9,990,887 | B2 * | 6/2018 | Chen | G09G 3/3233 |
| 2005/0083270 | A1 * | 4/2005 | Miyazawa | G09G 3/3233 345/76 |
| 2005/0099412 | A1 * | 5/2005 | Kasai | G09G 3/325 345/204 |
| 2007/0126663 | A1 * | 6/2007 | Kim | G09G 3/3241 345/76 |
| 2008/0150846 | A1 * | 6/2008 | Chung | G09G 3/3233 345/80 |
| 2010/0127955 | A1 * | 5/2010 | Choi | G09G 3/3233 345/76 |
| 2011/0069059 | A1 * | 3/2011 | Lee | G05F 1/56 345/212 |
| 2012/0162176 | A1 * | 6/2012 | Kim | G09G 3/3258 345/211 |
| 2014/0320549 | A1 * | 10/2014 | Kumeta | G09G 3/3225 345/690 |
| 2015/0302793 | A1 * | 10/2015 | In | G09G 3/3208 345/211 |
| 2016/0019844 | A1 * | 1/2016 | Yang | G09G 3/3233 345/205 |

* cited by examiner

REVERSIBLE BIAS ORGANIC LIGHT-EMITTING DIODE (OLED) DRIVE CIRCUIT WITHOUT INITIALIZATION VOLTAGE

TECHNICAL FIELD

This disclosure relates to display systems, and in particular to organic light-emitting diode (OLED) displays configured to allow a reduction in pixel size.

DESCRIPTION OF THE RELATED TECHNOLOGY

Organic light-emitting diode (OLED) displays may include circuits which can reverse the bias of the OLED elements. By periodically reversing the bias of the OLED, the lifetime of the OLED can be extended.

SUMMARY

The systems, methods and devices of this disclosure each have several innovative aspects, no single one of which is solely responsible for the desirable attributes disclosed herein.

One innovative aspect of the subject matter described in this disclosure can be implemented in an organic light-emitting diode (OLED) control circuit can be configured to receive signals from a data line, an emission line, a scan line, a high-power supply line and a low power supply line. The OLED control circuit can include an organic light-emitting diode (OLED) having an anode and a cathode, the cathode in electrical communication with the low power supply line, a driving transistor having a gate, a source, and a drain, the source of the driving transistor in electrical communication with the OLED and a drain of the driving transistor in electrical communication with the high-power supply line, a storage capacitor, a first plate of the storage capacitor in electrical communication with both the gate and the drain of the driving transistor, and a second plate of the storage capacitor in electrical communication with the low power supply line, a data switch transistor having a source in electrical communication with the data line, a drain in electrical communication with the drain of the driving transistor, and a gate in electrical communication with the scan line, and a first diode-connected transistor. The first diode-connected transistor having a gate, a drain, and a source, the drain of the first diode-connected transistor connected to the gate of the first diode-connected transistor and in electrical communication with the data line, and the source of the first diode-connected transistor in electrical communication with the anode of the OLED.

In some implementations, the circuit can additionally include a second diode-connected transistor having a source, a gate, and a drain, the drain of the second diode-connected transistor connected to the gate of the first diode-connected transistor and in electrical communication with the data line, and the source of the second diode-connected transistor in electrical communication with the first plate of the storage capacitor. The circuit can additionally include a first leak-suppressing transistor connected between the source of the first diode-connected transistor and the anode of the OLED. The circuit can additionally include a second leak-suppressing transistor connected between the source of the first diode-connected transistor and the first plate of the storage capacitor.

In some implementations, the circuit can additionally include a power conducting transistor, the power conducting transistor connected between the source of the driving transistor and the high-power supply line, the power conducting transistor having a gate in electrical communication with the emission line, a source in electrical communication with the high-power supply line, and a drain in electrical communication with the source of the power conduction transistor. The circuit can additionally include an OLED-connected transistor, the OLED-connected transistor connected between the data switching transistor and the anode of the OLED, the OLED-connected transistor having a gate in electrical communication with the emission line, a source in electrical communication with OLED, and a drain in electrical communication with the data switching transistor.

In some implementations, the OLED circuit can be configured to initialize the OLED by draining voltage from the anode of the OLED through the first diode-connected transistor to reverse the bias of the OLED. The first plate of the storage capacitor can be configured to store a reference voltage, and the reference voltage can be a function of a high data voltage applied on the on the data line and the threshold voltage of the driving transistor.

Another innovative aspect of the subject matter described in this disclosure can be implemented in an organic light-emitting diode (OLED) control circuit can be configured to receive signals from a data line, an emission line, a scan line, a high-power supply line and a low power supply line. The OLED control circuit can include an organic light-emitting diode (OLED) having an anode and a cathode, the cathode in electrical communication with the low power supply line, a driving transistor having a gate, a source, and a drain, the source of the driving transistor in electrical communication with the OLED and a drain of the driving transistor in electrical communication with the high-power supply line, means for storing a reference voltage, the reference voltage being a function of a high data voltage applied on the on the data line and the threshold voltage of the driving transistor, a data switch transistor having a source in electrical communication with the data line, a drain in electrical communication with the drain of the driving transistor, and a gate in electrical communication with the scan line, and means for initializing the OLED circuit by draining voltage from the anode of the OLED through the first diode-connected transistor to reverse the bias of the OLED.

In some implementations, the storage means can include a storage capacitor, a first plate of the storage capacitor in electrical communication with both the gate and the drain of the driving transistor, and a second plate of the storage capacitor in electrical communication with the low power supply line. The initializing means can include a first diode-connected transistor, the first diode-connected transistor having a gate, a drain, and a source, the drain of the first diode-connected transistor connected to the gate of the first diode-connected transistor and in electrical communication with the data line, and the source of the first diode-connected transistor in electrical communication with the anode of the OLED. The circuit can additionally include a second diode-connected transistor having a source, a gate, and a drain, the drain of the second diode-connected transistor connected to the gate of the first diode-connected transistor and in electrical communication with the data line, and the source of the second diode-connected transistor in electrical communication with the first plate of the storage capacitor. The circuit can additionally include a first leak-suppressing transistor connected between the source of the first diode-connected transistor and the anode of the OLED. The circuit can additionally include a second leak-suppressing transistor connected between the source of the first diode-connected transistor and the first plate of the storage capacitor.

In some implementations, the circuit can additionally include a power conducting transistor, the power conducting transistor connected between the source of the driving transistor and the high-power supply line, the power conducting transistor having a gate in electrical communication with the emission line, a source in electrical communication with the high-power supply line, and a drain in electrical communication with the source of the power conduction transistor. The circuit can additionally include an OLED-connected transistor, the OLED-connected transistor connected between the data switching transistor and the anode of the OLED, the OLED-connected transistor having a gate in electrical communication with the emission line, a source in electrical communication with OLED, and a drain in electrical communication with the data switching transistor.

Another innovative aspect of the subject matter described in this disclosure can be implemented in a method of controlling an organic light-emitting diode (OLED) circuit in electrical communication with a data line, an emission line, a scan line, a high-power supply line and a low power supply line can include initializing the OLED circuit by applying a low voltage signal on the data line, and placing an anode of an OLED in electrical communication with the low voltage signal via a diode-connected transistor, programming the OLED by applying a high voltage signal on the data line, and storing a reference voltage on a plate of a storage capacitor by charging the plate of the storage capacitor through a driving transistor of the OLED circuit, the reference voltage being a function of the high voltage signal applied on the data line and a threshold voltage of the driving transistor of the OLED circuit, and energizing the OLED by applying a current through the OLED.

In some implementations, initializing the OLED circuit can reverse the bias of the OLED. Energizing the OLED can include applying a current through the OLED which is independent of the threshold voltage of the driving transistor. The method can additionally include applying an emission signal on the emission line and simultaneously applying a scan signal on the scan line, where the emission signal is generated by driver circuitry in electrical communication with the OLED circuit, and where the scan signal is generated by the same driver circuitry.

Details of one or more implementations of the subject matter described in this disclosure are set forth in the accompanying drawings and the description below. Other features, aspects, and advantages will become apparent from the description, the drawings and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1:
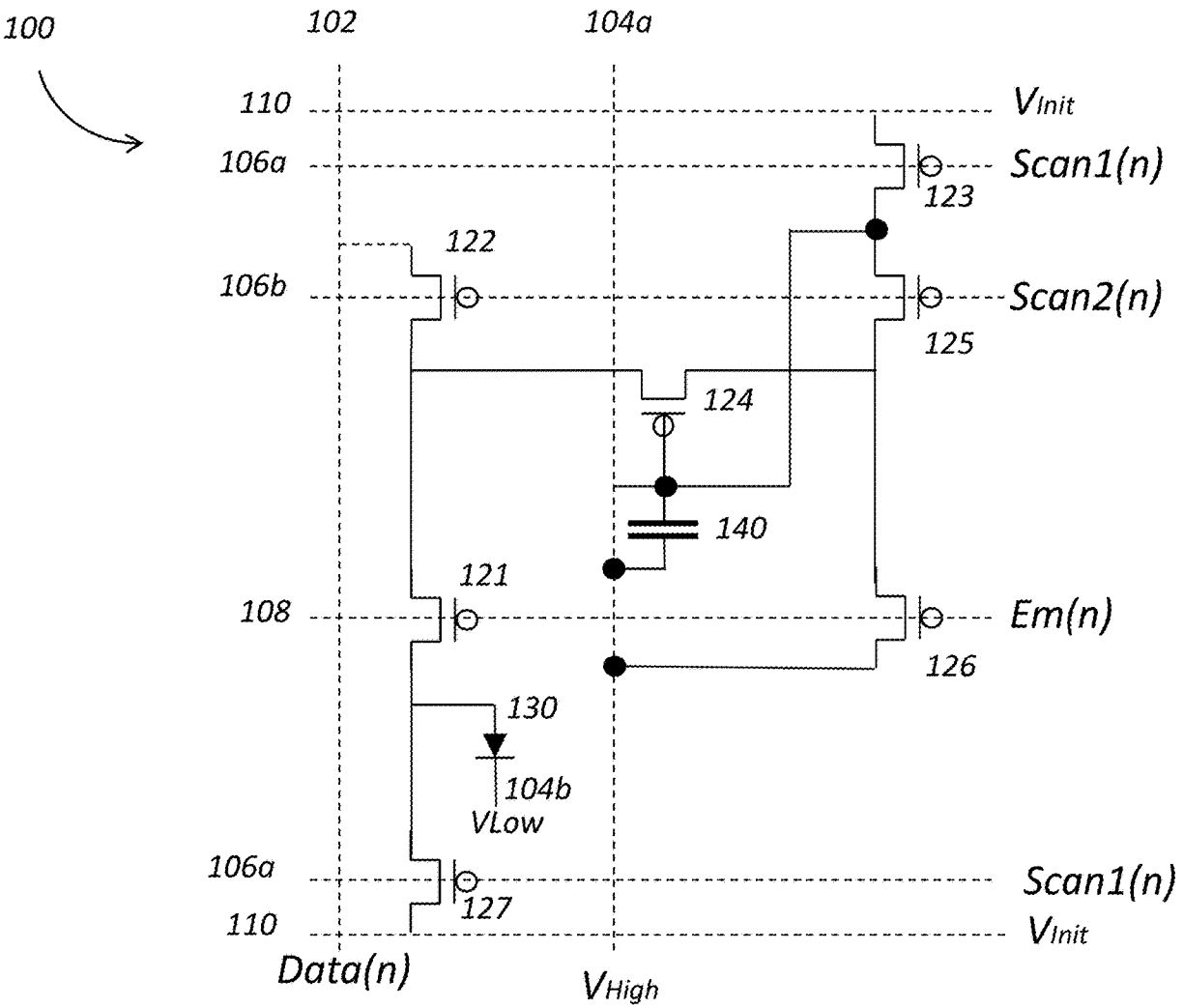
FIG. 1 schematically illustrates an example implementation of an OLED circuit which uses a dedicated initialization voltage to reverse the polarity of the OLED circuit.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that is capable of displaying an image, whether in motion (such as video) or stationary (such as still images), and whether textual, graphical or pictorial. The concepts and examples provided in this disclosure may be applicable to organic light-emitting diode (OLED) displays, in addition to displays incorporating features from one or more display technologies.

The described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, wearable devices, clocks, calculators, television monitors, flat panel displays, electronic reading devices (such as e-readers), computer monitors, auto displays (such as odometer and speedometer displays), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging and aesthetic structures (such as display of images on a piece of jewelry or clothing).

The lifetime of an OLED circuit may be extended by periodically reversing the bias of the OLED circuit to discharge the OLED. In some implementations of OLED arrays, each OLED circuit is in communication with a dedicated initialization voltage line, which can be used to reset the gate voltage of the driving thin-film transistor (TFT) to reverse the OLED bias. The inclusion of such dedicated initialization voltage lines, however, requires a substantial amount of area in an OLED array, as each OLED element must be in electrical communication with an initialization voltage line. In some implementations, OLED circuits can be configured to have reversible polarity without the use of a dedicated OLED circuit.

Particular implementations of the subject matter described in this disclosure can be implemented to realize one or more of the following potential advantages. By providing OLED circuits which are capable of reversing polarity, the useful lifetime of an OLED panel can be extended. By omitting the initialization voltage line, however, the pixel density of the OLED panel can be increased, as each row (or column) need not include space for a dedicated initialization voltage line. Instead, each OLED circuit can be driven using a single scan signal, an emission signal, and a data signal, simplifying the design and fabrication of the OLED circuit. In some implementations of OLED circuits described herein, additional advantages may be realized, including the simplification of the panel driver circuitry. For example, in some implementations, the emission signal and the scan signal may be generated using a single scan row driver.

FIG. 1 schematically illustrates an example implementation of an OLED circuit which uses a dedicated initialization voltage to reverse the polarity of the OLED circuit. In the illustrated implementation, components of the OLED circuit 100 are in electrical communication with a data line 102, a first power supply line 104*a* at a high voltage, an emission line 108, first and second scan lines 106*a* and 106*b*, and an initialization voltage line 110. The OLED circuit includes seven transistors 121-127, including a driving transistor 125 which is configured to control the state of OLED 130. The OLED 130 is also connected to a second power supply 104*b* at a voltage lower than the high voltage of the first power supply line 104*a*. A capacitor 140 is connected to the gate of driving transistor 125.

The first scan line 106*a* is connected to the gates of transistor 123 and 127. Second scan line 106*b* is connected to the gates of transistors 122 and 125. The emission line 108 is connected to the gates of transistors 121 and 126. The first power supply line 104 is connected to the source of transistor 126 and to the plate of capacitor 140 opposite the gate of driving transistor 125. The initialization voltage line 110 is connected to the source of transistor 123 and to the source of transistor 127, and can be used to reset the gate voltage of the driving TFT 125 to reset the gate voltage of the driving transistor 125 reverse the bias of the OLED circuit.

Figure 2:
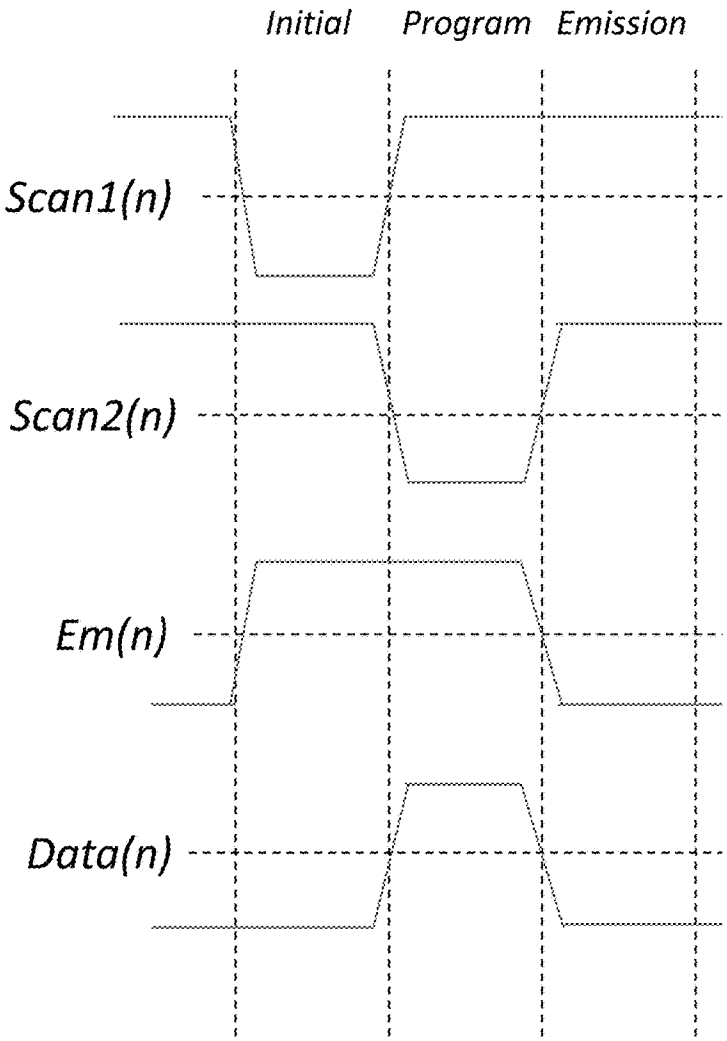
FIG. 2 illustrates examples of data signals that can be applied to the OLED circuit of FIG. 1.

FIG. 2 illustrates examples of data signals that can be applied to the OLED circuit of FIG. 1. In operation, the OLED may be initialized by applying low signal on the data line 102 and the first scan line 106*a*, and high signals on the emission line 108 and the second scan line 106*b*. The OLED may then be programmed by applying high signals on the emission line 108 and the first scan line 106*a*, and low signals on the data line 102 and the second scan lines 106*b*. Then, in an emission stage, high signals are applied on the first and second scan lines 106*a* and 106*b*, and low signals are applied on the emission line 108 and the data line 102. For a given frame, the polarity of the OLED circuit can be controlled via the initialization voltage line 110.

For the bias each of the OLED circuits in an OLED display to be reversible, an OLED display utilizing the circuit of FIG. 1 includes a dedicated initialization line in each line or row of the OLED display. The large number of dedicated initialization lines in such an OLED display impacts the possible pixel density of the OLED display. Such a design represents a tradeoff between longevity of the OLEDs within the display and pixel density. In some other implementations, however, the bias may be reversed without the need for a dedicated initialization voltage line, allowing greater pixel density along with the increased longevity from reversing the bias of the OLED.

Figure 3:
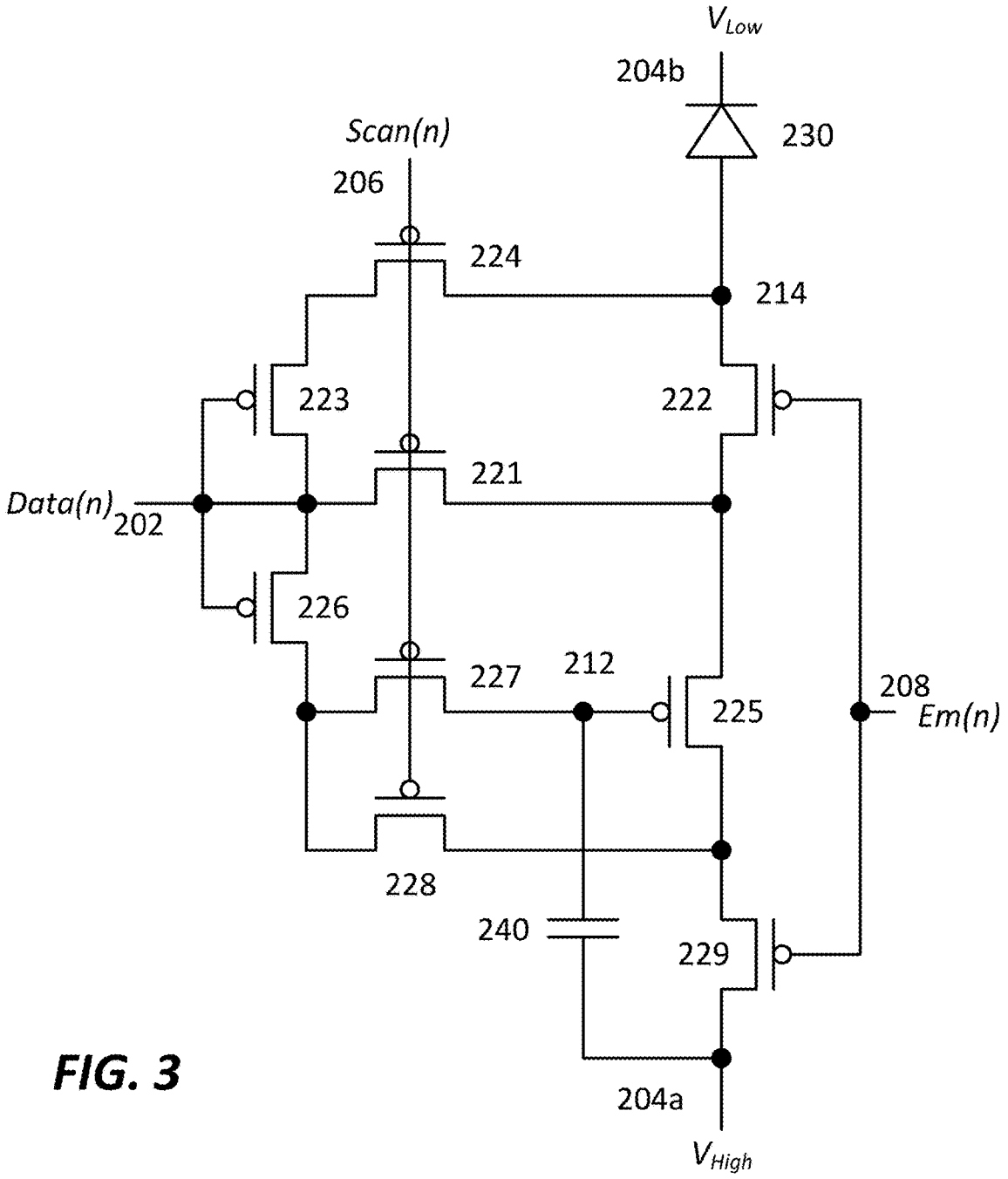
FIG. 3 schematically illustrates an example implementation of an OLED circuit which can reverse the polarity of the OLED circuit without the need for a dedicated initialization voltage line.

FIG. 3 schematically illustrates an example implementation of an OLED circuit which can reverse the polarity of the OLED circuit without the need for a dedicated initialization voltage line. The reversible OLED circuit 200 includes a data line 202, a first voltage line 204*a*, a second voltage line 204*b*, a scan line 206, and an emission line 208. The data line 202 is connected to the source of data switch transistor 221 and the drains of diode-connected transistors 223 and 226. The scan line 206 is connected to the gates of transistors 221, 224, 227, and 228. The emission line 208 is connected to the gates of transistors 222 and 229. The first power supply line 204*a* is connected to the source of transistor 229, as well as to the plate of capacitor 240 opposite the gate of driving transistor 225.

It can be seen in FIG. 3 that the transistors 223 and 226 are diode-connected, with an electrical connection between the drain of the transistor and the gate of the transistor. As described in greater detail herein, this configuration allows the initialization of the anode of the OLED 230 without the need for a dedicated initialization voltage line, such as the initialization voltage line 110 of the OLED circuit 100 of FIG. 1. Because such diode-connected transistors can be susceptible to leakage, leak suppressing transistors 224 and 227 are connected to the sources of the diode-connected transistors 226 and 223, respectively. In some implementations, the initializing voltage for the OLED 230 can be applied directly to the OLED 230 from the data line 202 during an initialization period, rather than during an addressing period.

Figure 4A:
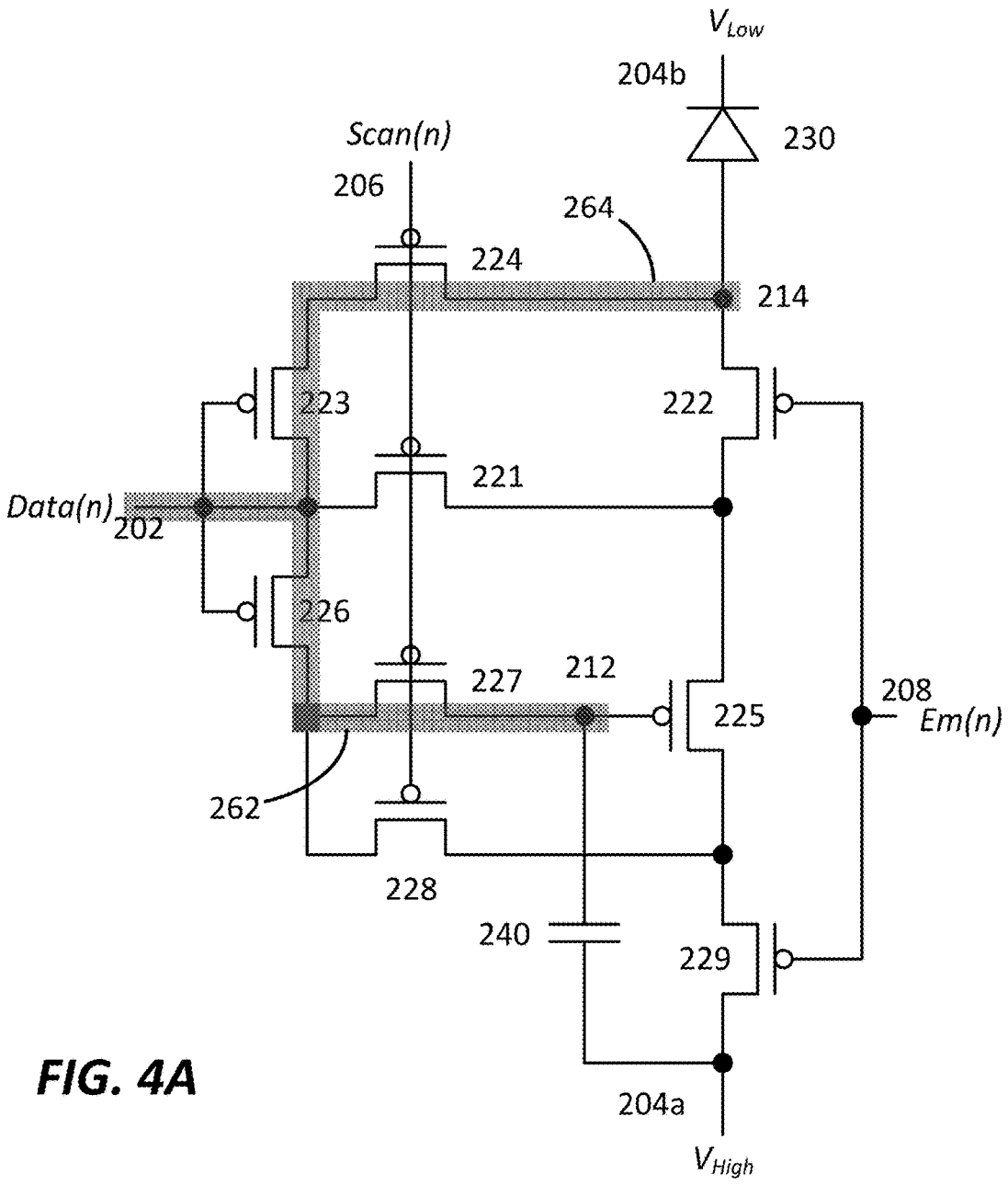
FIGS. 4A to 4C schematically illustrate example stages in the driving scheme of the OLED circuit of FIG. 3.
Figure 4B:
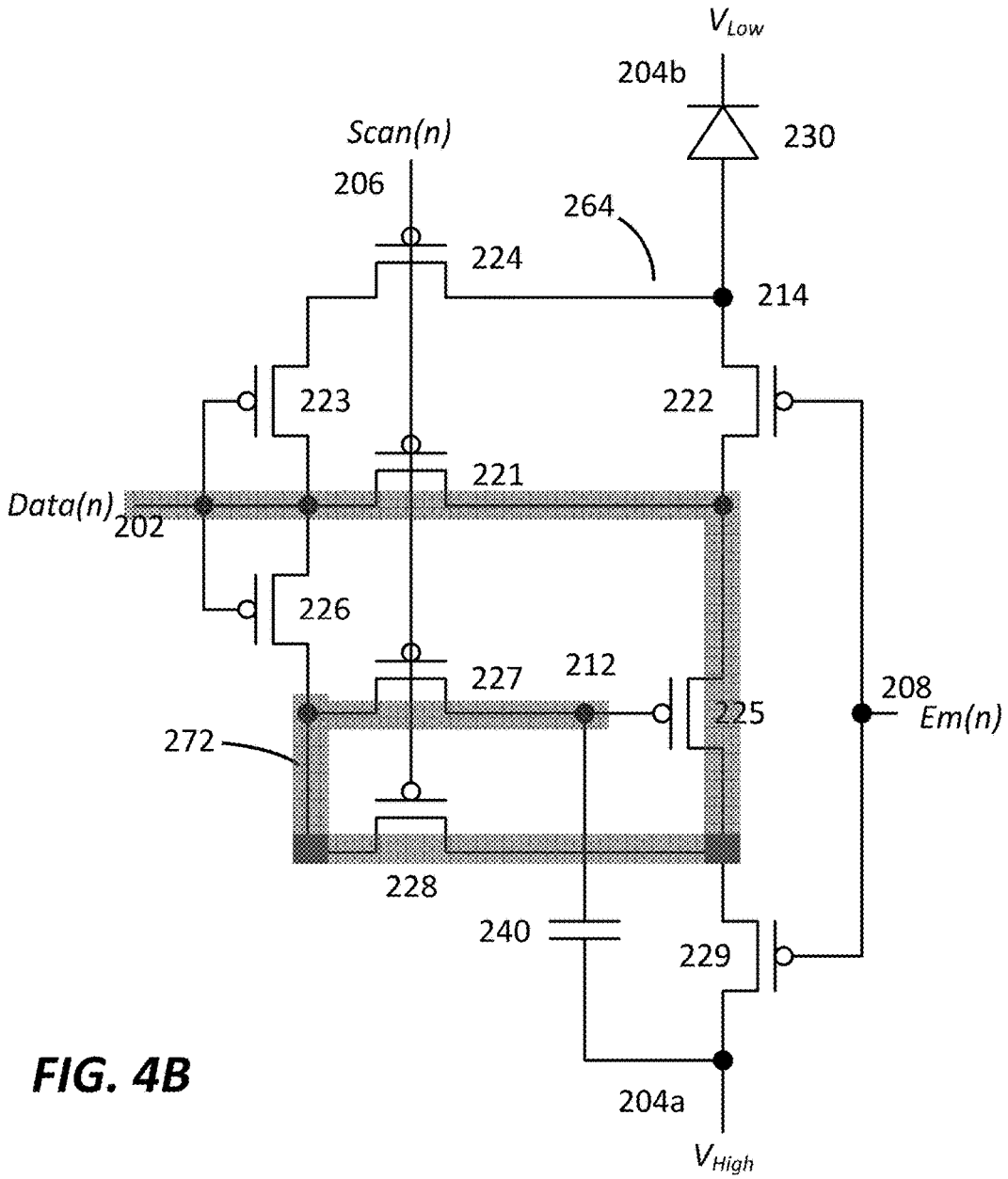
Figure 4C:
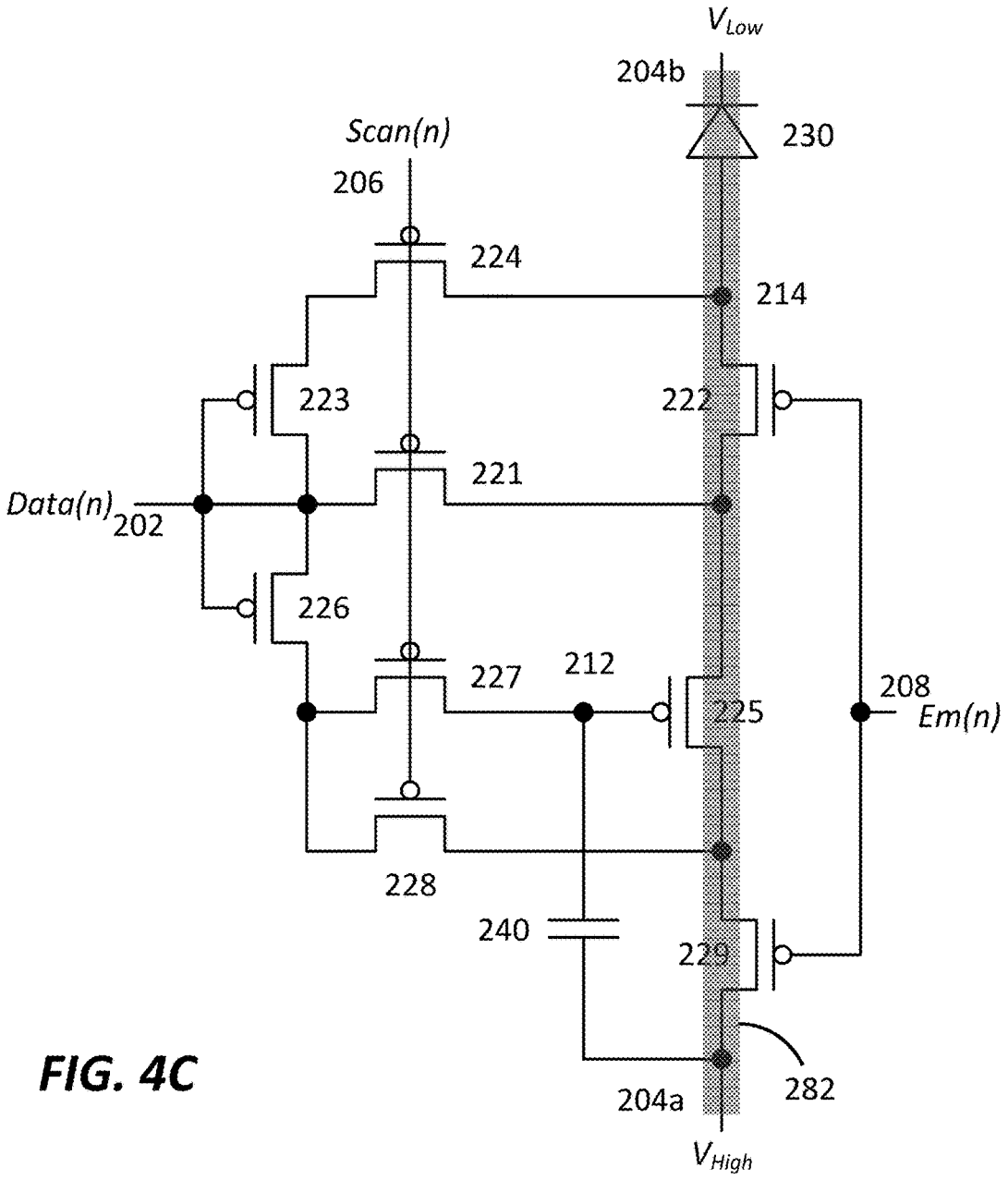
Figure 5:
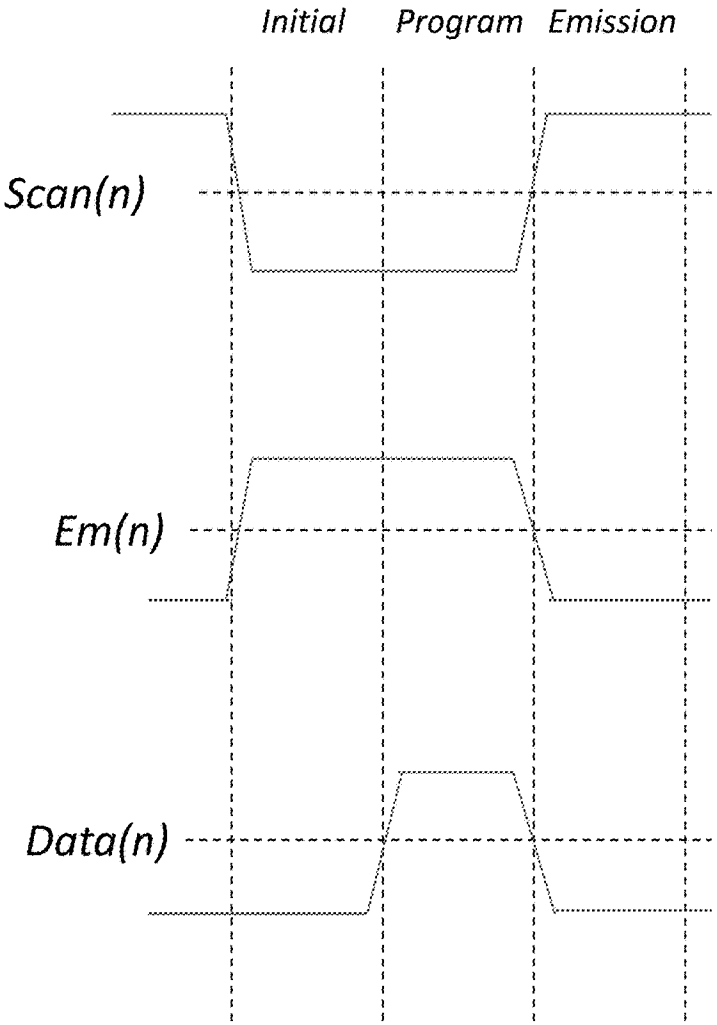
FIG. 5 illustrates examples of data signals that can be applied to the OLED circuit of FIG. 3 in the driving scheme of FIGS. 4A to 4C.

FIGS. 4A to 4C schematically illustrate example stages in the driving scheme of the OLED circuit of FIG. 3. FIG. 5 illustrates examples of data signals that can be applied to the OLED circuit of FIG. 3 in the driving scheme of FIGS. 4A to 4C.

FIG. 4A illustrates the OLED circuit 200 in an initialization phase. In the illustrated implementation, a low data voltage $V_{DataLow}$ is applied on the data line 202 and a low scan voltage $V_{ScanLow}$ is applied on the scan line 206. Simultaneously, a high emissions voltage $V_{EmHigh}$ is applied on the emission line 208. This turns the power conduction transistor 229 off, along with the OLED control transistor 222. The transistors 221, 224, 227, and 228 along the scan line 206, along with the diode-connected transistors 223 and 226, are turned on.

The voltage at location 214, at the anode of the OLED 230, will be discharged through diode-connected transistor 223 if it is sufficiently high. FIG. 4A schematically illustrates the discharge path 264 from the location 214 to the data line 202. If the voltage at location 214 is higher than ($V_{DataLow}$+|$V_{Th6}$|), where $V_{Th6}$ is the threshold voltage of transistor 226, the voltage will be discharged to ($V_{DataLow}$+|$V_{Th6}$|). However, if the voltage at location 214 is lower than ($V_{DataLow}$+|$V_{Th6}$|), it will remain at the low value. As the voltage at location 214 is at a low voltage, the bias of the OLED 230 is reversed.

Similarly, the voltage at location 212, at the gate of driving transistor 225 and the adjacent plate of the storage capacitor 240, will be discharged through diode-connected transistor 226 if the voltage at location 212 is sufficiently high. FIG. 4A schematically illustrates the discharge path 262 from the location 212 to the data line 202. If the voltage at location 212 is higher than ($V_{DataLow}$+|$V_{Th3}$|), where $V_{Th3}$ is the threshold voltage of transistor 223, the voltage will be discharged to ($V_{DataLow}$+|$V_{Th3}$|). If the voltage at location 212 is below ($V_{DataLow}$+|$V_{Th5}$|), where $V_{Th5}$ is the threshold voltage of driving transistor 225, the voltage at location 212 will be charged to ($V_{DataLow}$+|$V_{Th5}$) through the driving transistor 225.

Because the transistors 223 and 226 are diode-connected, their threshold voltages $V_{Th3}$ and $V_{Th6}$ can be used to control the voltages to which the locations 212 and 214 are discharged when a low voltage $V_{DataLow}$ is applied on the data line 202. The threshold voltages limit the discharge to a voltage higher than the low voltage $V_{DataLow}$.

FIG. 4B illustrates the OLED circuit 200 in a programming phase. In the illustrated implementation, a high data voltage $V_{DataHigh}$ is applied on the data line 202 and a high emissions voltage $V_{EmHigh}$ is applied on the emission line 208. Simultaneously, a low scan voltage $V_{ScanLow}$ is applied on the scan line 206. The power conduction transistor 229 remains off, along with the OLED control transistor 222. In addition, the diode-connected transistors 223 and 226 are turned off. The transistors 221, 224, 227, and 228 along the scan line 206 remain on.

The voltage at location 214 will remain unaffected during this programming phase, remaining at the voltage to which it was discharged during the initialization phase, if it was not already at a low voltage. The OLED 230 thus remains at a reversed bias. The voltage at location 212, however, will be charged to a voltage which is dependent on the threshold voltage of the driving transistor 225. FIG. 4B schematically illustrates the charge path 272 from the data line 202, through driving transistor 252, to the location 212 at the gate of driving transistor. The voltage will be charged to ($V_{DataHigh}$−|$V_{Th5}$|), at which point the driving transistor 225 will be turned off By setting the voltage at location 212 to a voltage which is dependent upon the threshold voltage $V_{Th5}$, the voltage on the connected plate of the storage capacitor 240 can be set to a voltage which is dependent upon the data line voltage and the threshold voltage $V_{Th5}$. Using this, the OLED circuit 200 can compensate for the threshold voltage $V_{Th5}$, and drive the OLED 230 using a current which is independent of the threshold voltage $V_{Th5}$.

It can be seen in FIG. 4B that if the diode-connected transistors 223 and 226 are leaky, the high voltage on the data line 202 could affect the voltage to which location 212 is charged. The threshold voltages $V_{Th3}$ and $V_{Th3}$ can be selected to be between −1.5 Volts and −2.5 Volts to minimize or prevent the effect of the leak current. The threshold voltage of a pMOS or nMOS transistor can be controlled by controlling the doping density during the fabrication process.

FIG. 4C illustrates the OLED circuit 200 in an emission phase. In the illustrated implementation, a low emissions voltage $V_{EmLow}$ is applied on the emission line 208, and a low data voltage $V_{DataHigh}$ is applied on the data line 202. The transistors 221, 224, 227, and 228 along the scan line 206 are turned off, and the power conduction transistor 229 and the OLED control transistor 222 are turned on.

Because the transistor 227 is turned off, the voltage at location 212 at the gate of driving transistor 225 and on the adjacent plate of storage capacitor 240 remains at ($V_{DataHigh}$−|$V_{Th5}$|). Current flows through OLED 230 from the first voltage line 204*a* along path 282. Because the stress gate voltage is also a function of the threshold voltage $V_{Th5}$ of the driving transistor 225, the current I through the OLED can be defined as a function of the square of the difference between the high voltage $V_{High}$ and the high data voltage $V_{DataHigh}$ which remains stored on the storage capacitor 240. The current I through the OLED is therefore independent of the driving voltage, due to the voltage compensation which occurs during the programming phase. The high data voltage $V_{DataHigh}$ may be any suitable value greater than the maximum voltage across the OLED $V_{OLEDHigh}$ but less than the high voltage $V_{High}$ supplied by the first voltage line 204*a*.

It can be seen in FIG. 5 that the emission signal applied on the emission line 208 is, during each phase of the illustrated driving scheme, the inverse of the data signal applied on the data line 202. A further advantage of the OLED configuration is the ability to utilize a single row driver to generate both the emission signal and the data signal, or otherwise use at least some common circuitry to generate both the emission signal and the data signal. In addition to the increased pixel density allowed by the omission of a dedicated initialization voltage line, an OLED display which requires one scan signal and generates that scan signal and an emission signal using the same driver circuitry also can result in a decrease in border size at the edge of the display. Because the border does not need to accommodate both an emission row driver and a separate scan row driver, the border area without OLED pixels can be made smaller, resulting in an increase of active display space relative to overall display space.

Figure 6:
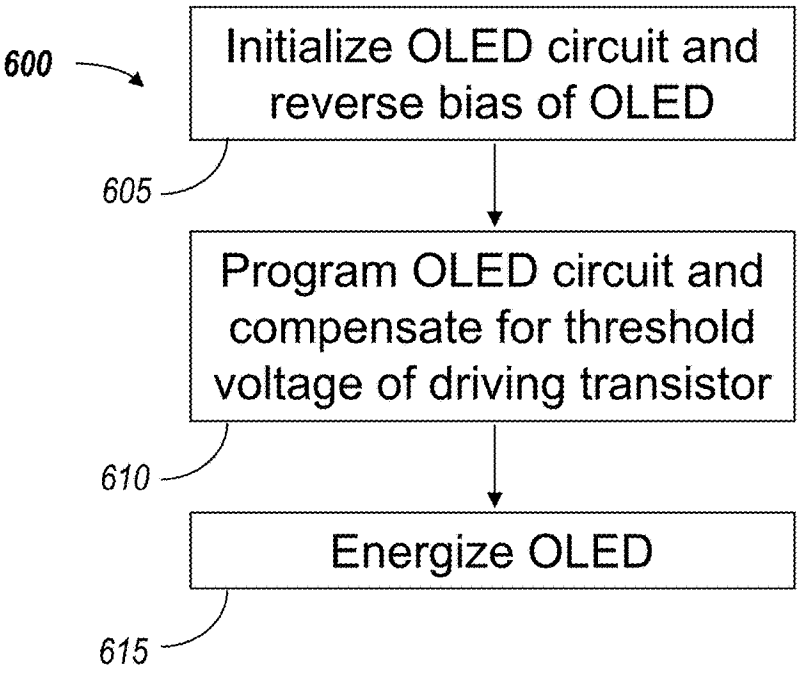
FIG. 6 is a flow diagram illustrating certain stages in an example process for driving an OLED circuit such as the OLED circuit of FIG. 3.

FIG. 6 is a flow diagram illustrating certain stages in an example process for driving an OLED circuit such as the OLED circuit of FIG. 3. The process includes a stage 605 where the OLED circuit is initialized. A low data voltage is applied on the data line of the OLED circuit, and a low scan voltage is applied on the scan line of the OLED circuit. A high emission voltage is applied on the emission line to turn off the power conducting transistor and the OLED-connected transistor of the OLED circuit, so the OLED will not be energized. The remaining components of the OLED circuit are configured such that the voltage at the plate of a storage capacitor opposite the plate connected to a high-power source is discharged through a diode-connected transistor. Similarly, the voltage at the anode of the OLED is discharged through a diode-connected transistor. The resulting voltage at each of these locations may be dependent upon the threshold voltage of the diode-connected transistor through which they are discharged. The OLED is discharged by this process, if needed, and the bias of the OLED is now reversed.

The process includes a stage 610 where the OLED circuit is programmed. The emission line signal remains at a low emission voltage, so that the OLED remains not energized, and the bias of the OLED remains reversed. The scan signal remains at a low scan voltage, but a high data voltage is applied on the data line. The voltage at the plate of a storage capacitor opposite the plate connected to a high-power source is increased to a voltage which is a function of the high data voltage and the threshold voltage of the driving transistor of the OLED circuit, writing this information to the storage capacitor.

The process includes a stage 615 where the OLED is energized. A high emission voltage is now applied on the emission line, turning on the power conduction transistor and the OLED-connected transistor, and allowing a current to flow through the OLED, energizing the OLED. At the same time, a high scan voltage is applied on the scan line, and a low data voltage is applied on the data line. Because the voltage stored on the plate of the storage capacitor opposite the high-power source is a function of the threshold voltage of the driving conductor, the current flowing through the OLED at stage 615 is independent of the threshold voltage of the driving conductor.

The OLED circuit illustrated in FIG. 3 is merely one possible implementation of an OLED circuit having features described herein. Several other OLED circuit arrangements may be provided which include at least some of the features discussed herein.

Figure 7A:
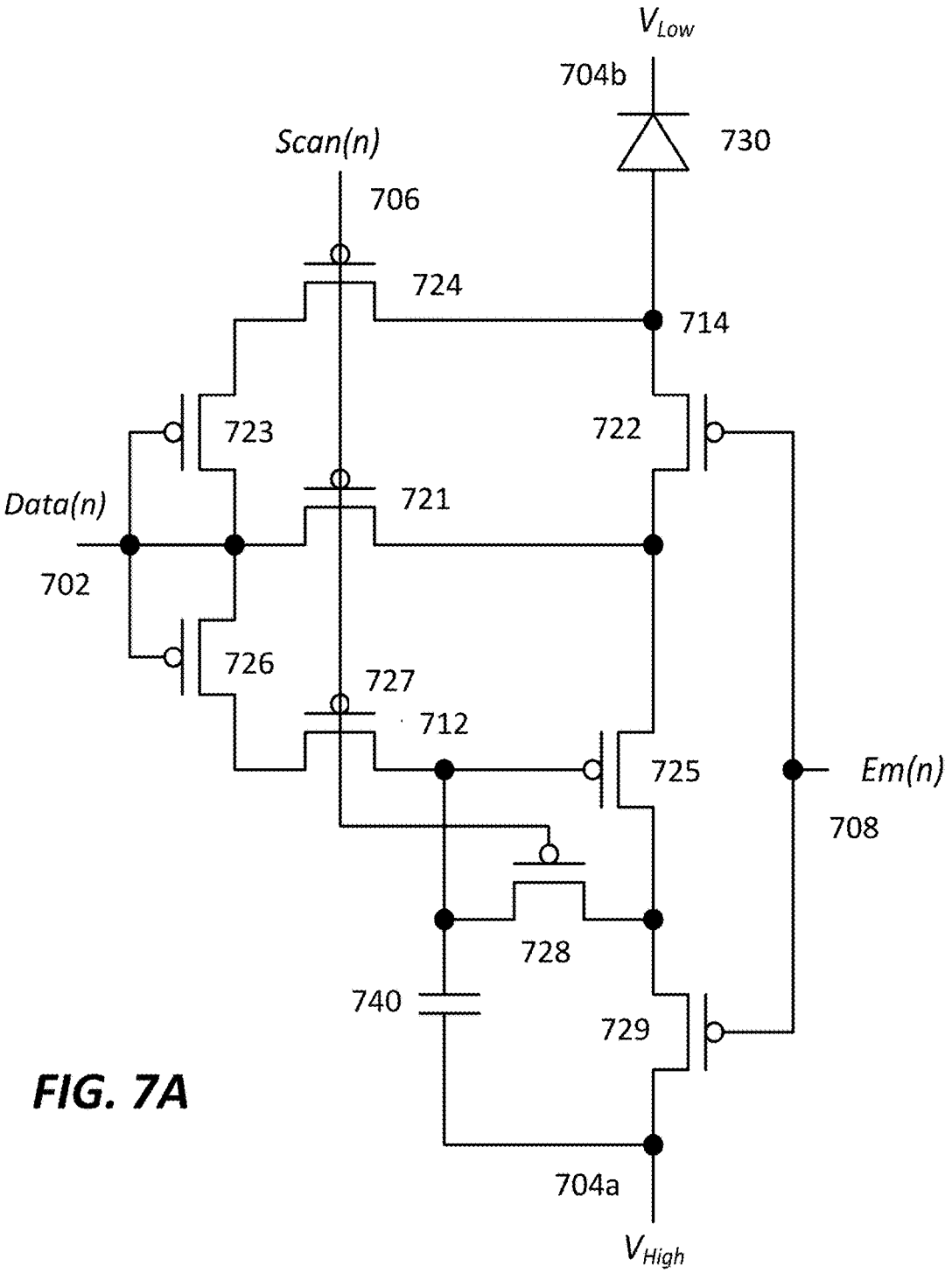
FIG. 7A schematically illustrates an alternative implementation of an example OLED circuit.

FIG. 7A schematically illustrates an alternative implementation of an example OLED circuit. Like the OLED circuit 200 of FIG. 3, the OLED circuit 700 includes two diode-connected transistors 723 and 728. The voltage at the anode of the OLED 730 can be discharged through transistor 724 and diode-connected transistor 723 during an initialization phase of a driving scheme, and the voltage at the gate of driving transistor 725 can be discharged through transistor 727 and diode-connected transistor 726. In a subsequent programming phase, the voltage at a plate of the storage capacitor 740 can be charged to a voltage which is a function of the threshold voltage of the driving capacitor, compensating for the threshold voltage of the driving capacitor. The same drive signals may be applied to drive the OLED circuit 700 as were applied to drive the OLED circuit 200.

Figure 7B:
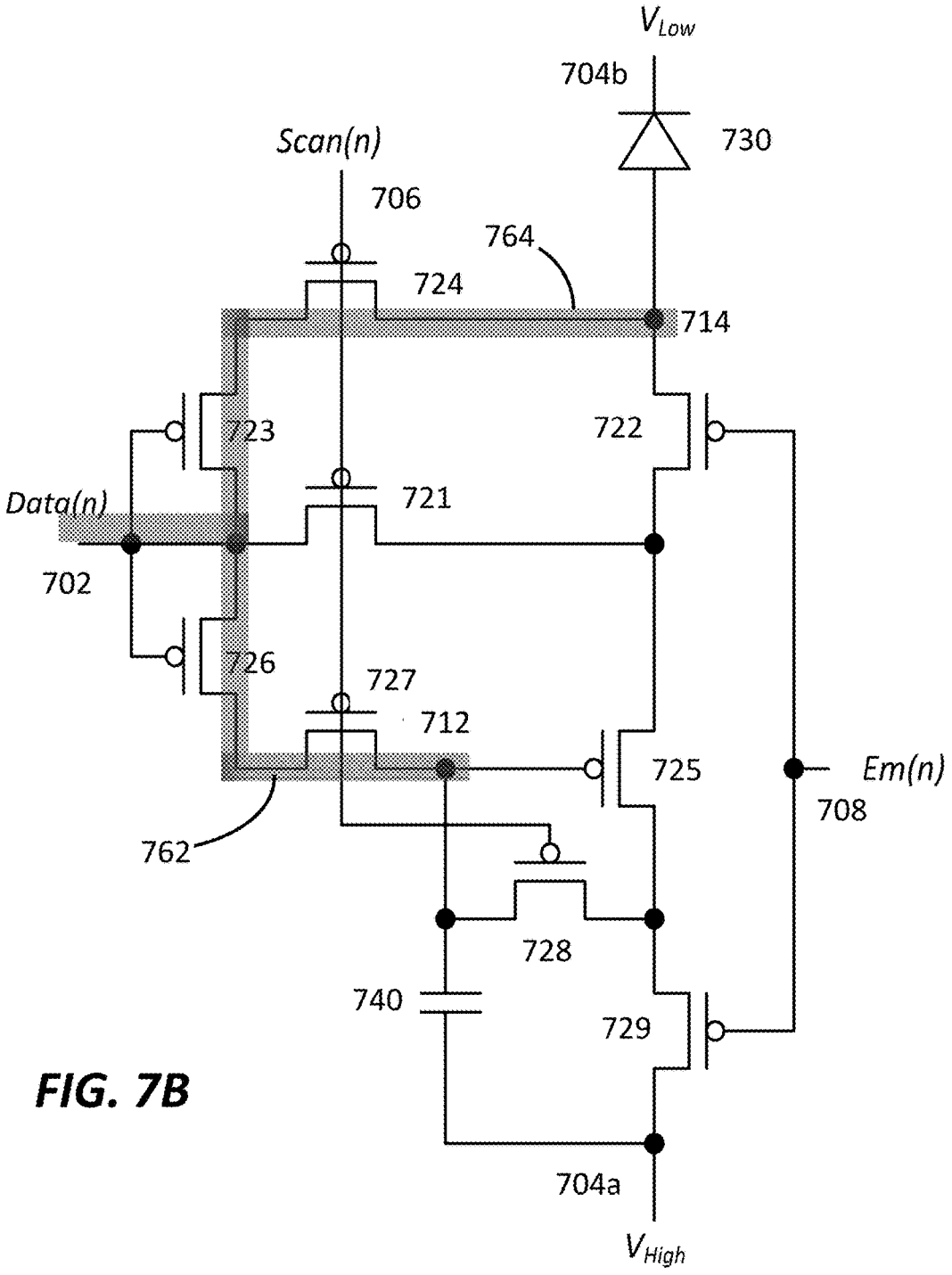
FIGS. 7B to 7D schematically illustrate the operation of the example OLED circuit of FIG. 7A.
Figure 7C:
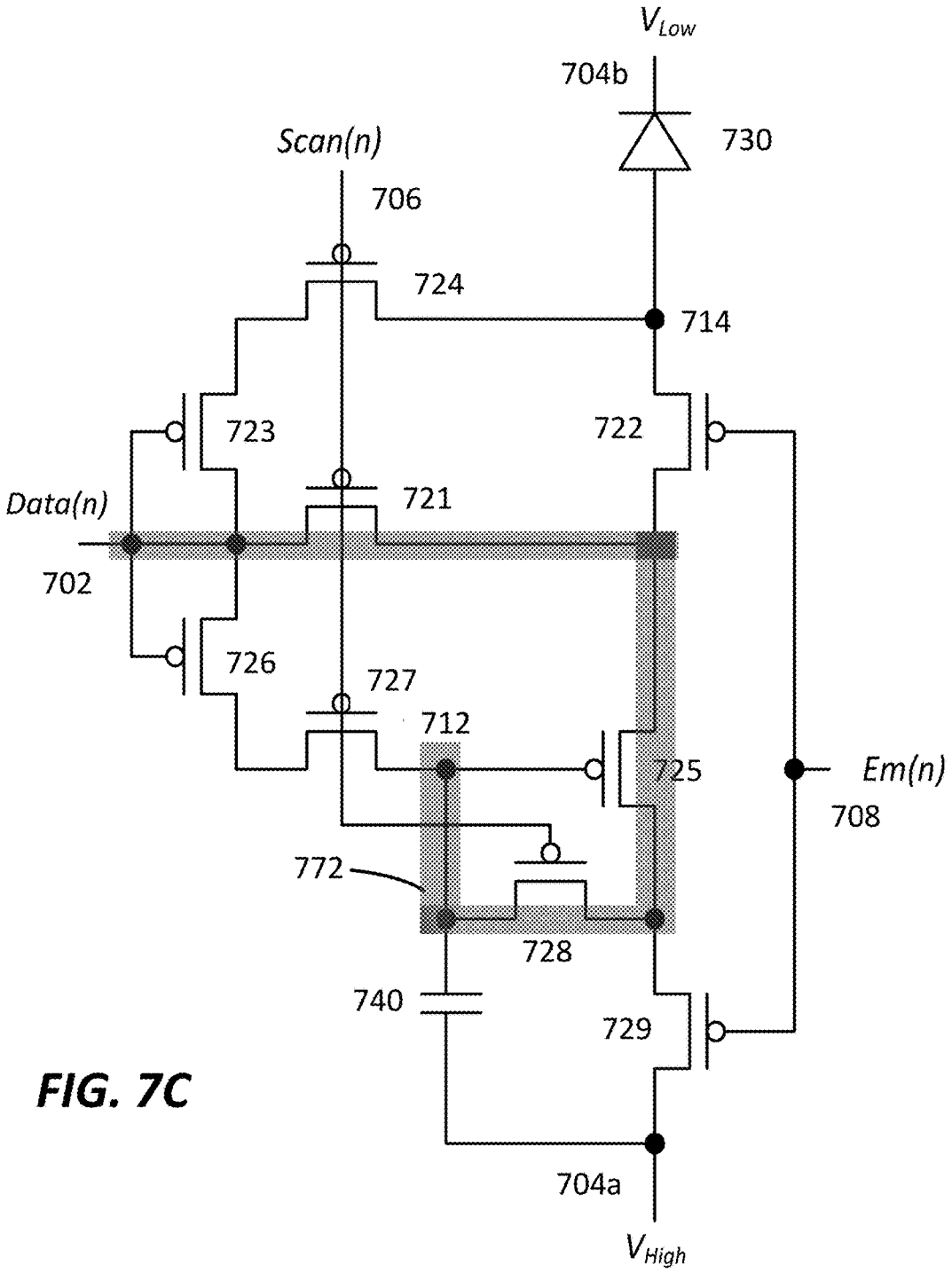
Figure 7D:
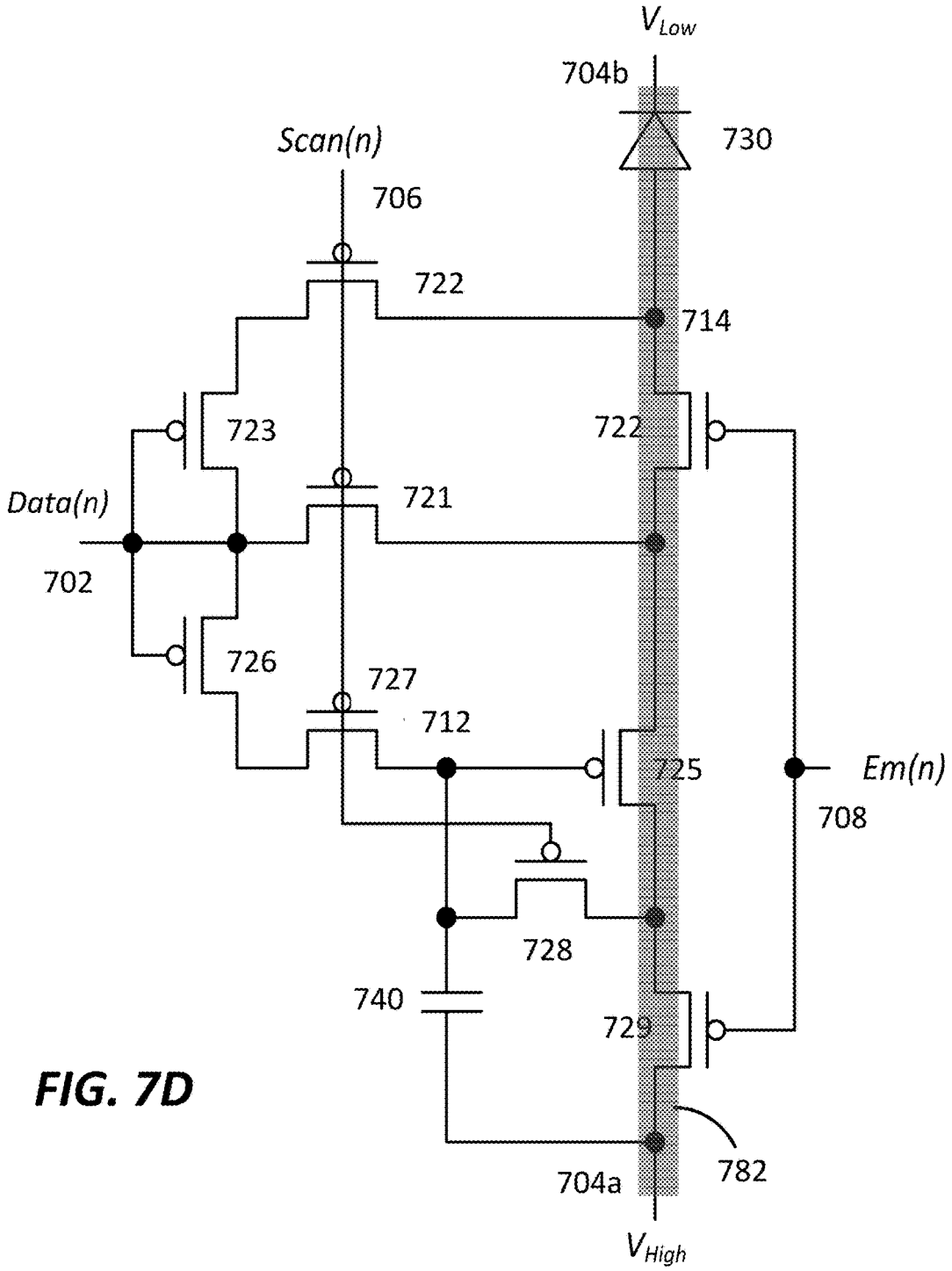

FIGS. 7B to 7D schematically illustrate the operation of the example OLED circuit of FIG. 7A. As can be seen in FIG. 7B, in the initialization phase, when a low scan voltage is applied on scan line 706, a low data voltage is applied on data line 702, and a high emission voltage is applied on the emission line, the voltage at location 714 at the anode of the OLED 730 may be discharged along discharge path 764 through transistor 727 and diode-connected transistor 723 if the voltage is sufficiently high. Similarly, the voltage at location 712 at the gate of driving transistor 725 may be discharged along discharge path 762 through transistor 724 and diode-connected transistor 726 if the voltage is sufficiently high.

As can be seen in FIG. 7C, in the programming phase, when a low scan voltage is applied on scan line 706, a high data voltage is applied on data line 702, and a high emission voltage is applied on the emission line, the voltage at the plate of the storage capacitor 740 will be charged to a voltage ($V_{DataHigh}-|V_{Th5}|$). As the potential at the plate of storage capacitor 740 is equal to the potential at location 712 at the gate of driving transistor 725, the driving transistor 725 will be turned off once the potential reaches ($V_{DataHigh}-|V_{Th5}|$). This charging will occur along path 772 passing from the data line 702 through data switch transistor 721, driving transistor 725, and transistor 728. Transistors 724 and 727 may serve a leak-suppression function in the OLED circuit 700, particularly during this programming phase, due to possible leakage through diode-connected transistors 723 and 726.

As can be seen in FIG. 7D, in the emission phase, when a low emission voltage is applied on the emission line 708 and a low data voltage is applied on the data line 702, the OLED 730 is energized by current flowing along path 782 through power conduction transistor 729, driving transistor 725, and OLED-connected transistor 722. In some implementations, because the threshold voltage of driving transistor 725 was stored on storage capacitor 740 during the programming phase, the current through the OLED 730 will again be independent of the threshold voltage of the driving transistor 725, resulting in greater uniformity across an OLED display.

Figure 8A:
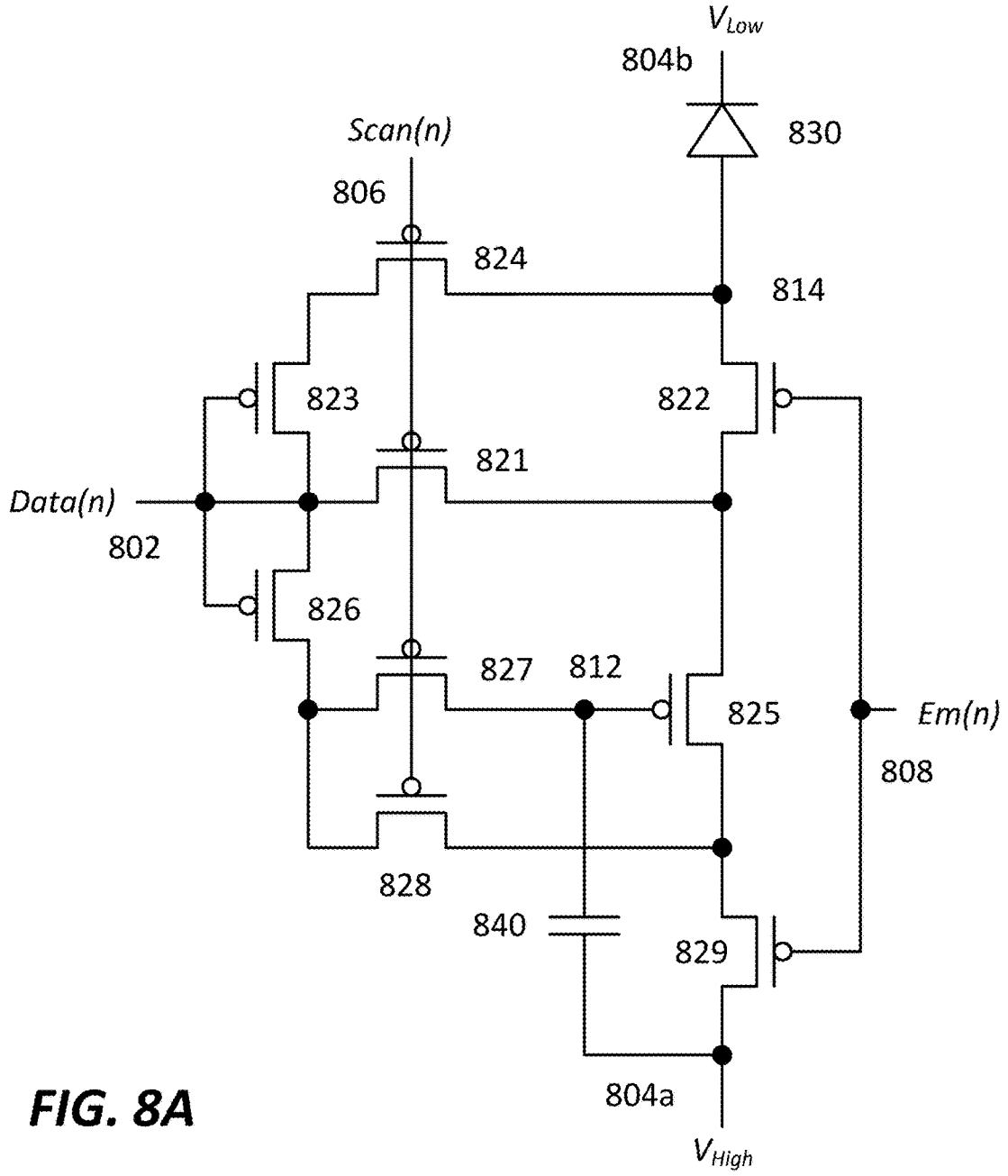
FIG. 8A schematically illustrates an alternative implementation of an example OLED circuit.

FIG. 8A schematically illustrates an alternative implementation of an example OLED circuit. The OLED circuit 800 also includes nine total transistors, including two diode-connected transistors 823 and 826. However, the OLED circuit 800 differs from the OLED circuits in that, in an initialization phase, the voltages at the anode of the OLED 830 and at the plate of the storage capacitor 840 will each be discharged through data switch transistor 821, among other transistors.

Figure 8B:
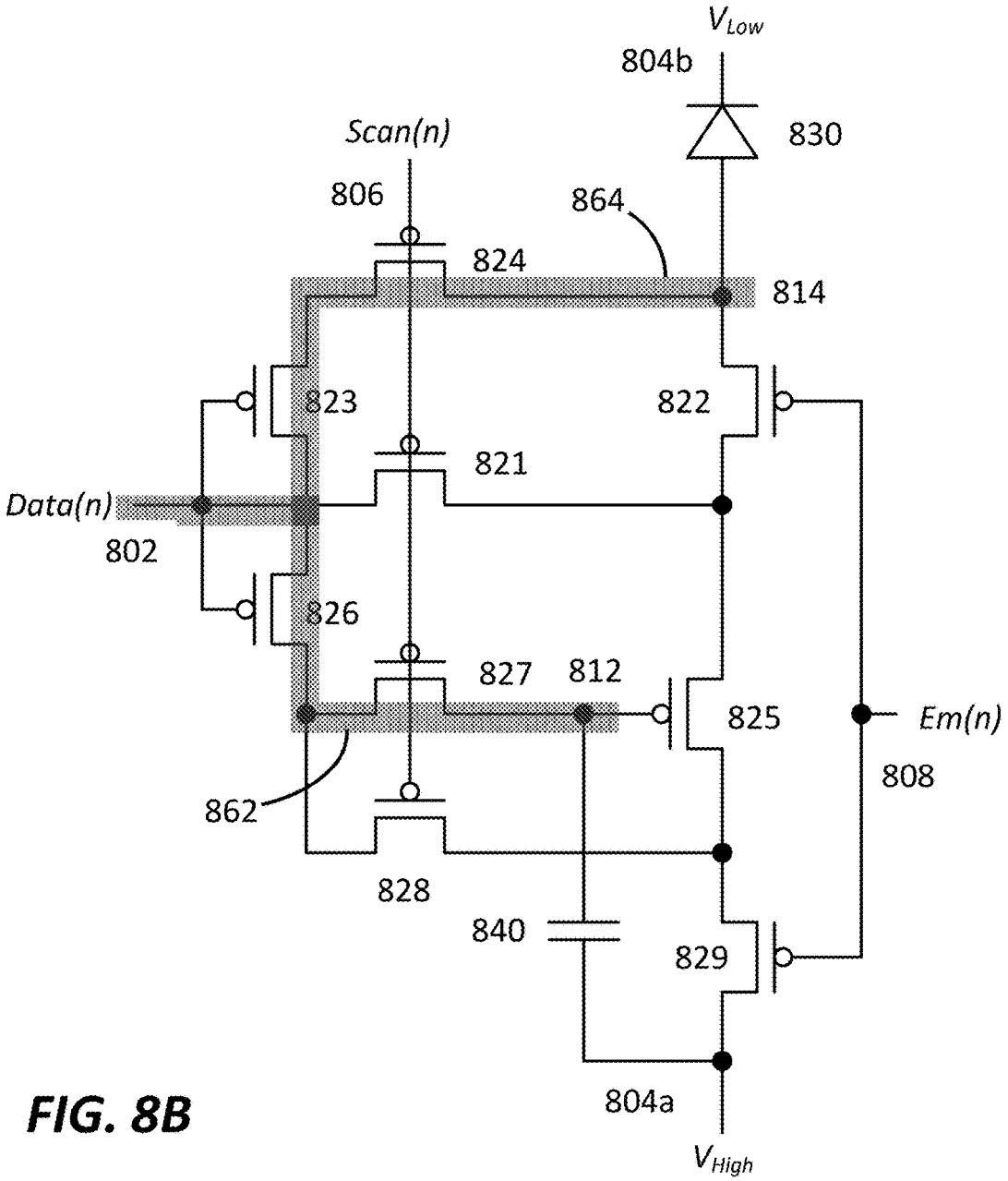
FIGS. 8B to 8D schematically illustrate the operation of the example OLED circuit of FIG. 8A.
Figure 8C:
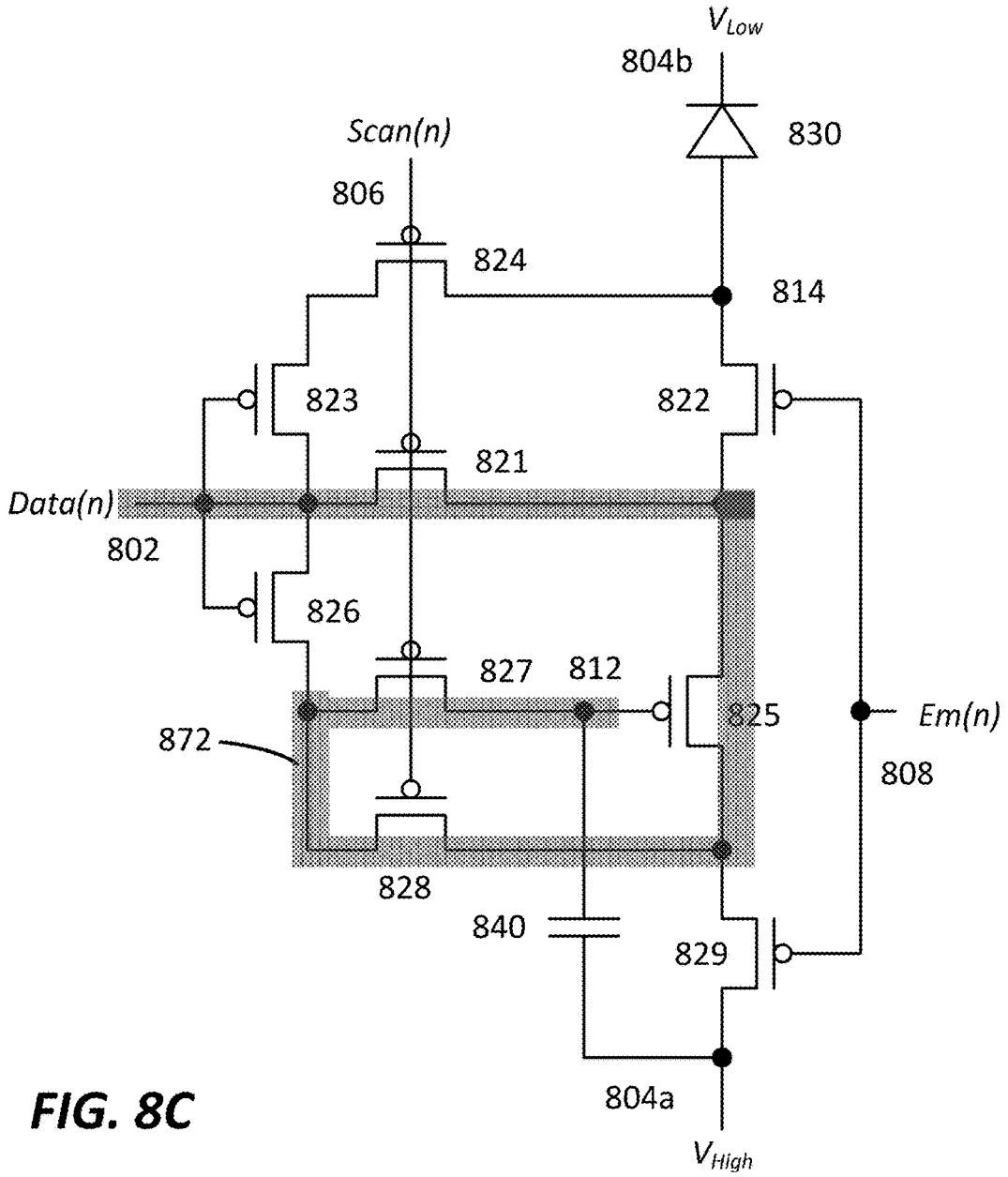
Figure 8D:
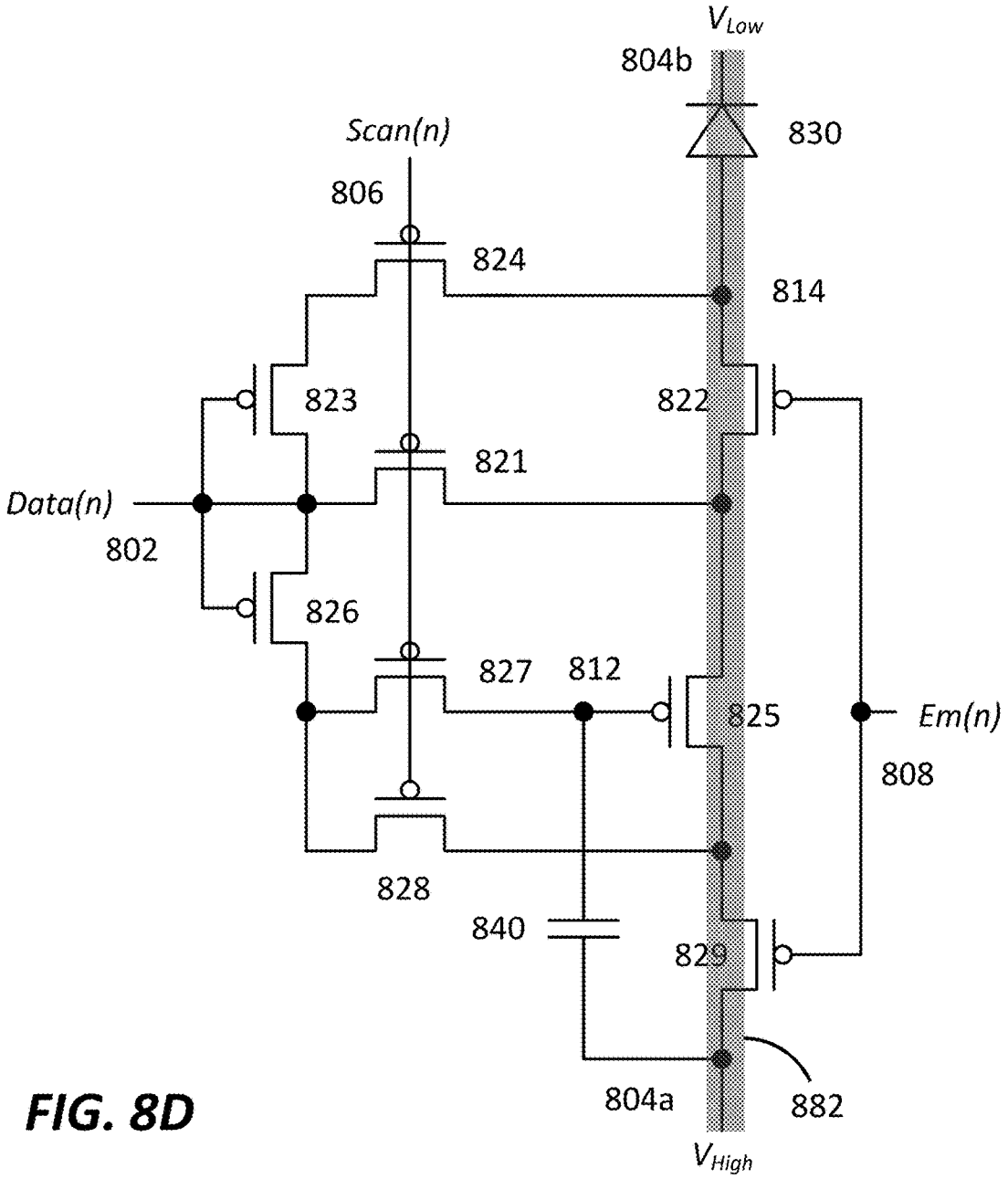

FIGS. 8B to 8D schematically illustrate the operation of the example OLED circuit of FIG. 8A. As can be seen in FIG. 8B, in the initialization phase, when a low scan voltage is applied on scan line 806, a low data voltage is applied on data line 802, and a high emission voltage is applied on the emission line, the voltage at location 814 at the anode of the OLED 830 may be discharged along discharge path 864 through diode-connected transistor 823 and transistor 824. The voltage at location 812 at the plate of storage conductor 840 may be discharged along discharge path 862 through transistor 827 and diode-connected transistor 826 if the voltage is sufficiently high.

As can be seen in FIG. 8C, in the programming phase, when a low scan voltage is applied on scan line 806, a high data voltage is applied on data line 802, and a high emission voltage is applied on the emission line, the voltage at the plate of the storage capacitor 840 will be charged to a voltage ($V_{DataHigh}-|V_{Th5}|$). As the potential at location 812 at the plate of storage capacitor 840 is equal to the potential at the gate of driving transistor 825, the driving transistor 825 will be turned off once the potential reaches ($V_{DataHigh}-|V_{Th5}|$). This charging will occur along path 872 passing from the data line 802 through data switch transistor 821, driving transistor 825, and transistor 828. Transistors 824 and 827 may serve a leak-suppression function in the OLED circuit 800, particularly during this programming phase, due to possible leakage through diode-connected transistor 823 and 826.

As can be seen in FIG. 8D, in the emission phase, when a low emission voltage is applied on the emission line 808 and a low data voltage is applied on the data line 802, the OLED 830 is energized by current flowing along path 882 through power conduction transistor 829, driving transistor 825, and OLED-connected transistor 822. The current through the OLED 830 will be independent of the threshold voltage of the driving transistor 825 due to the voltage compensation in the programming phase.

FIG. 9 schematically illustrates an alternative implementation of an example OLED circuit. The OLED circuit 900 also includes nine total transistors, including two diode-connected transistors 923 and 926. The data switch transistor 921 is connected between the data line 902 and the diode-connected transistors 923 and 926. The OLED circuit 900 will discharge voltages from both the plate of the storage capacitor 940 and the anode of the OLED 930 along paths which include the data switch transistor 921 in addition to one of the diode-connected transistors 923 and 926.

Figure 9A:
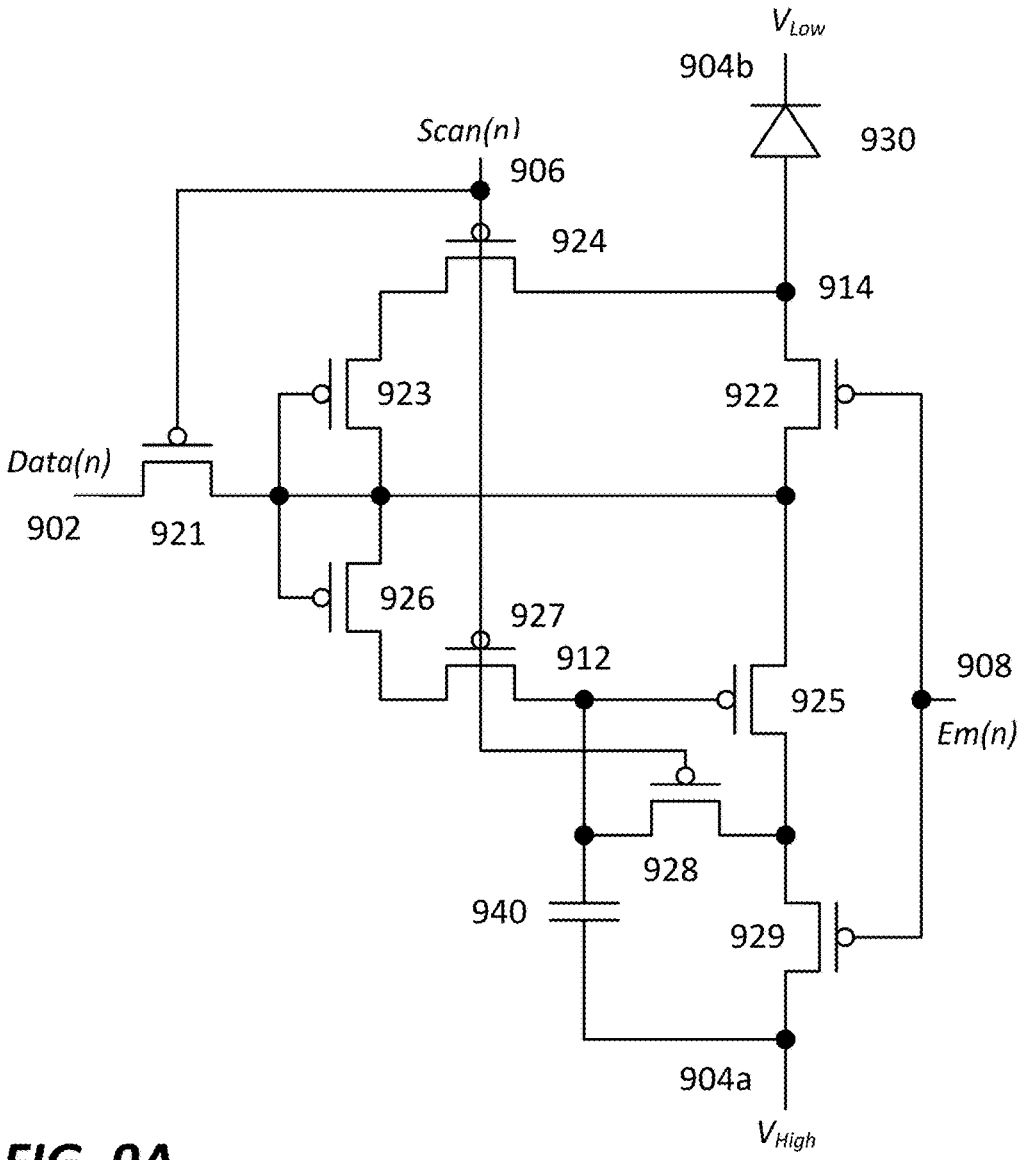
FIG. 9A schematically illustrates an alternative implementation of an example OLED circuit.
Figure 9B:
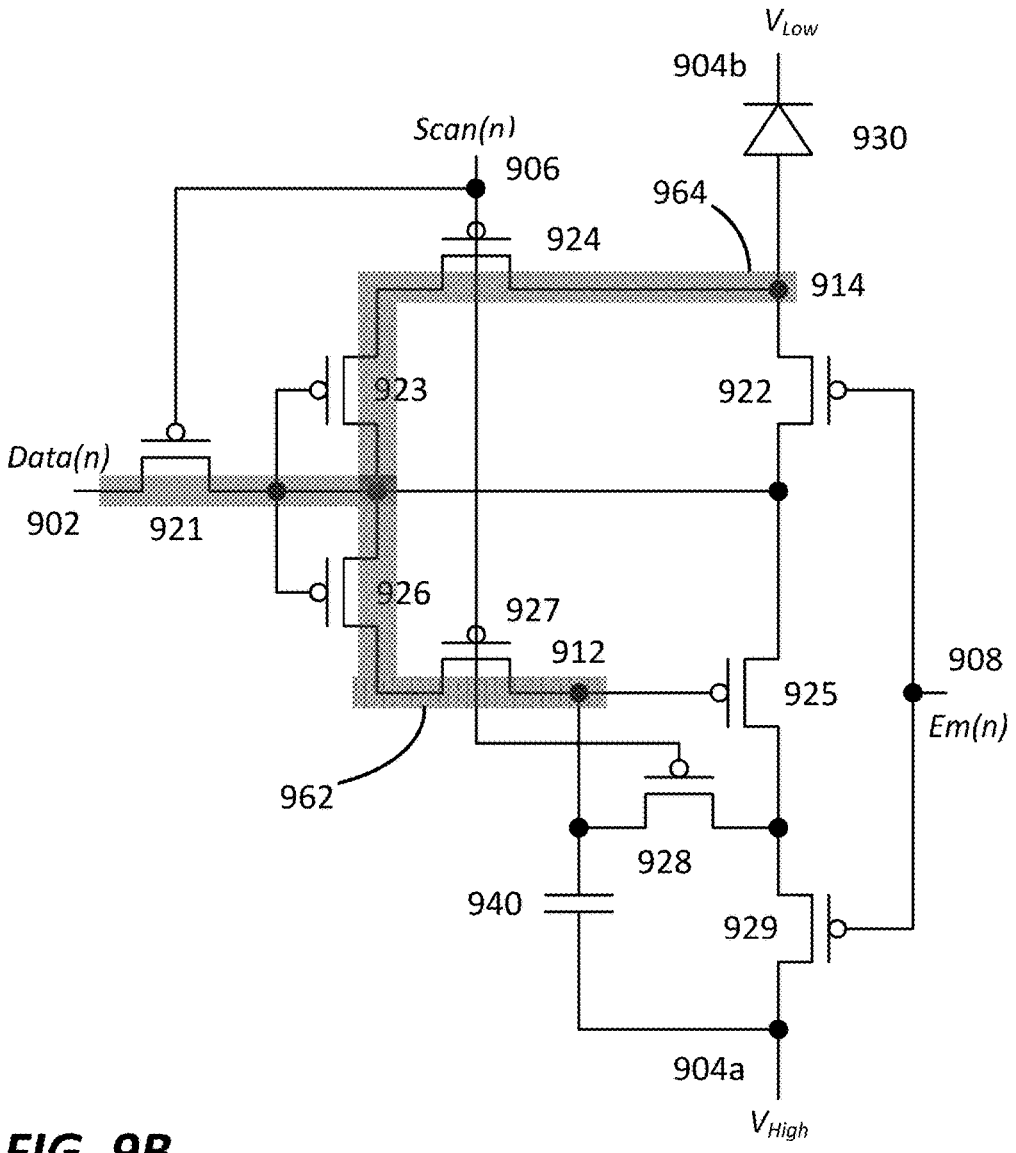
FIGS. 9B to 9D schematically illustrate the operation of the example OLED circuit of FIG. 9A.
Figure 9C:
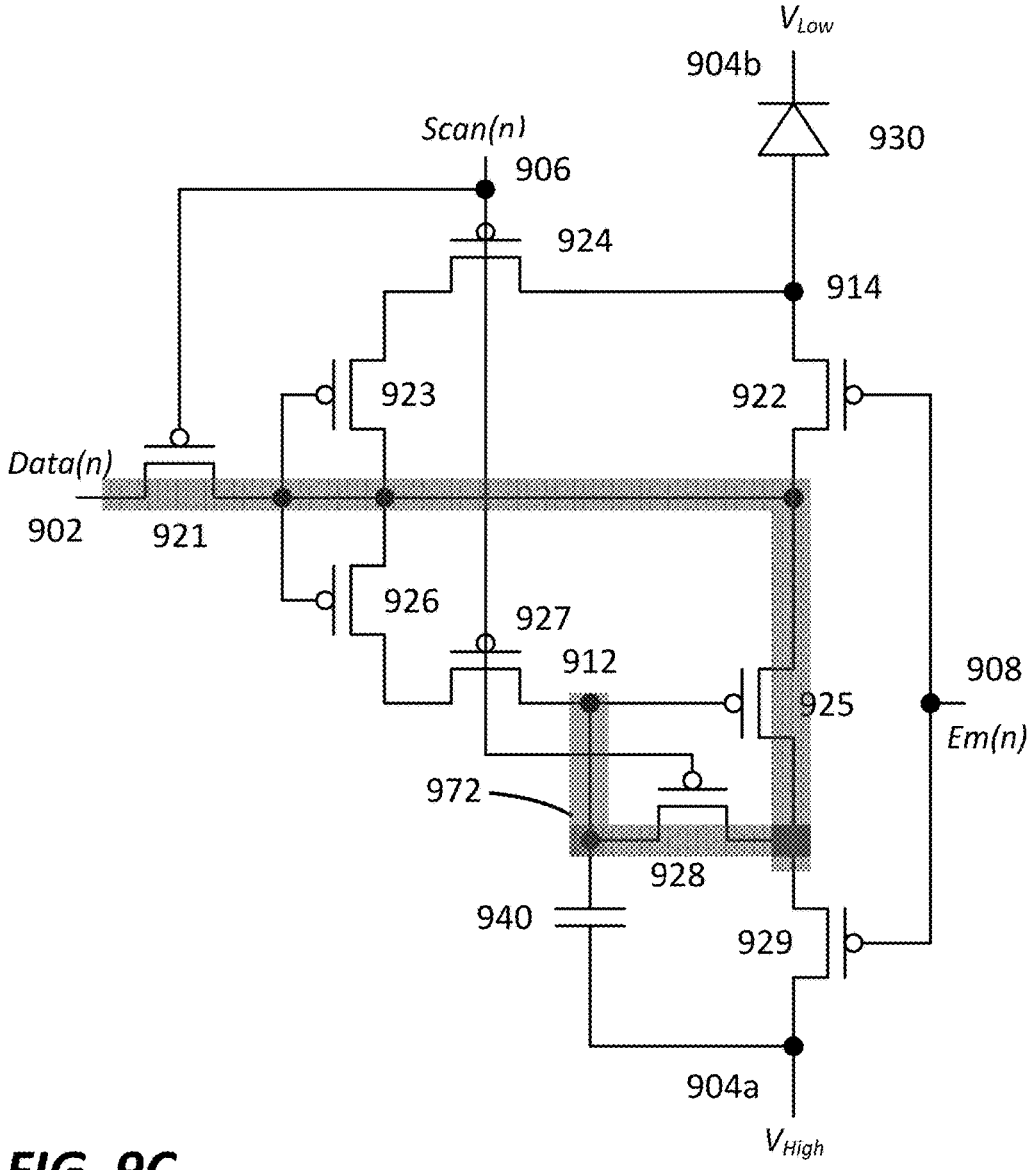
Figure 9D:
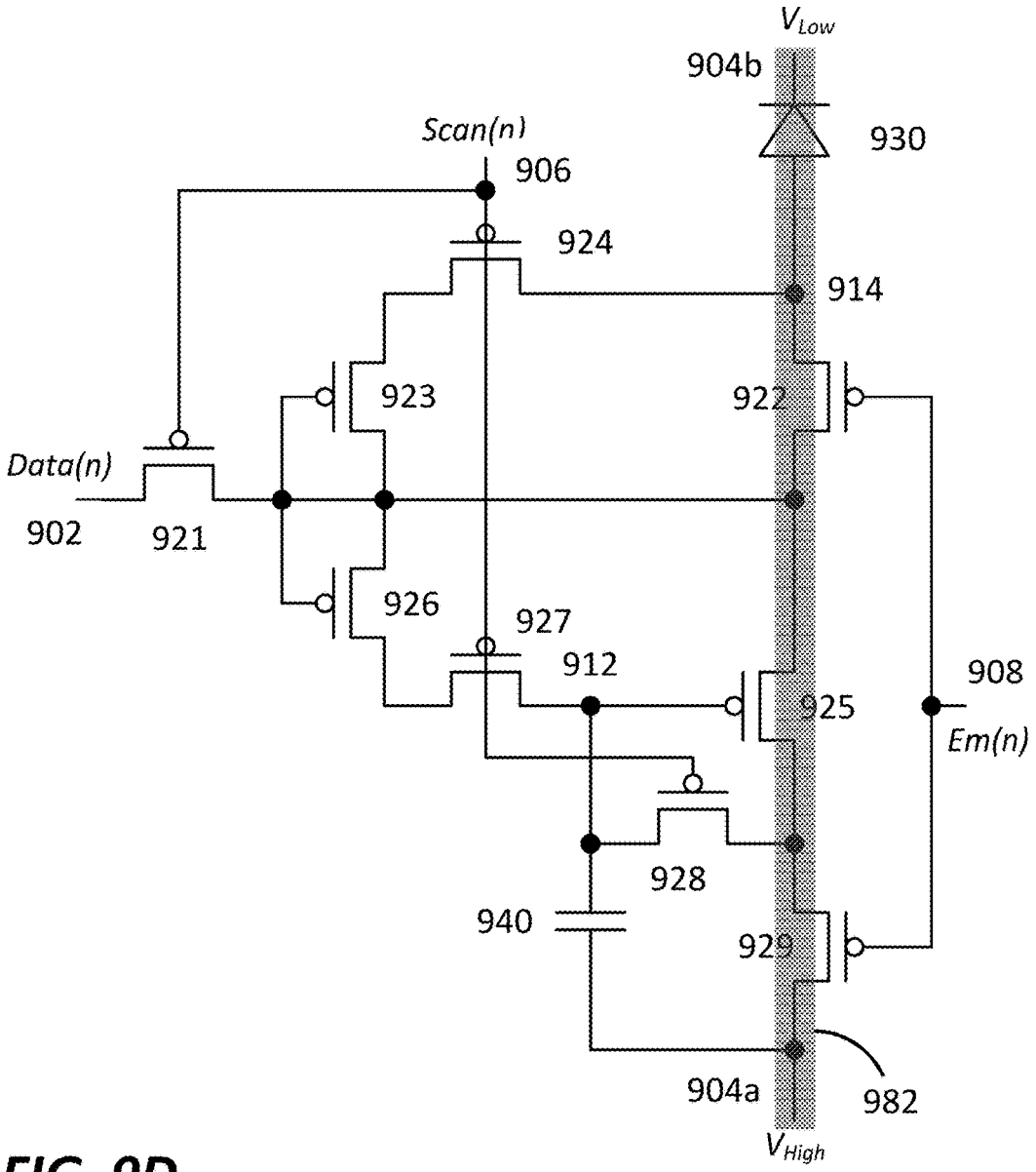

FIGS. 9B to 9D schematically illustrate the operation of the example OLED circuit of FIG. 9A. As can be seen in FIG. 9B, in the initialization phase, when a low scan voltage is applied on scan line 906, a low data voltage is applied on data line 902, and a high emission voltage is applied on the emission line, the voltage at location 914 at the anode of the OLED 930 may be discharged along discharge path 964 through transistor 924, diode-connected transistor 923, and data switch transistor 921. The voltage at location 912 at the plate of storage conductor 940 may be discharged along discharge path 962 through transistor 927, diode-connected transistor 926, and data switch transistor 921, if the voltage is sufficiently high. Each of these potential discharge paths pass through the data switch transistor 921 after passing through a diode-connected transistor.

As can be seen in FIG. 9C, in the programming phase, when a low scan voltage is applied on scan line 906, a high data voltage is applied on data line 902, and a high emission voltage is applied on the emission line, the voltage at the plate of the storage capacitor 940 will be charged to a voltage ($V_{DataHigh}-|V_{Th5}|$). As the potential at location 912 at the plate of storage capacitor 940 is equal to the potential at the gate of driving transistor 925, the driving transistor 925 will be turned off once the potential reaches ($V_{DataHigh}-|V_{Th5}|$). This charging will occur along path 972 passing from the data line 902 through data switch transistor 921, driving transistor 925, and transistor 928. Transistors 924 and 927 may serve a leak-suppression function in the OLED circuit 900, particularly during this programming phase, due to possible leakage through diode-connected transistor 923 and 926.

As can be seen in FIG. 9D, in the emission phase, when a low emission voltage is applied on the emission line 908 and a low data voltage is applied on the data line 902, the OLED 930 is energized by current flowing along path 982 through power conduction transistor 929, driving transistor 825, and OLED-connected transistor 822. The current through the OLED 930 during the emissions phase is independent of the threshold voltage of the driving transistor 925 due to the voltage compensation in the programming phase.

Figure 10A:
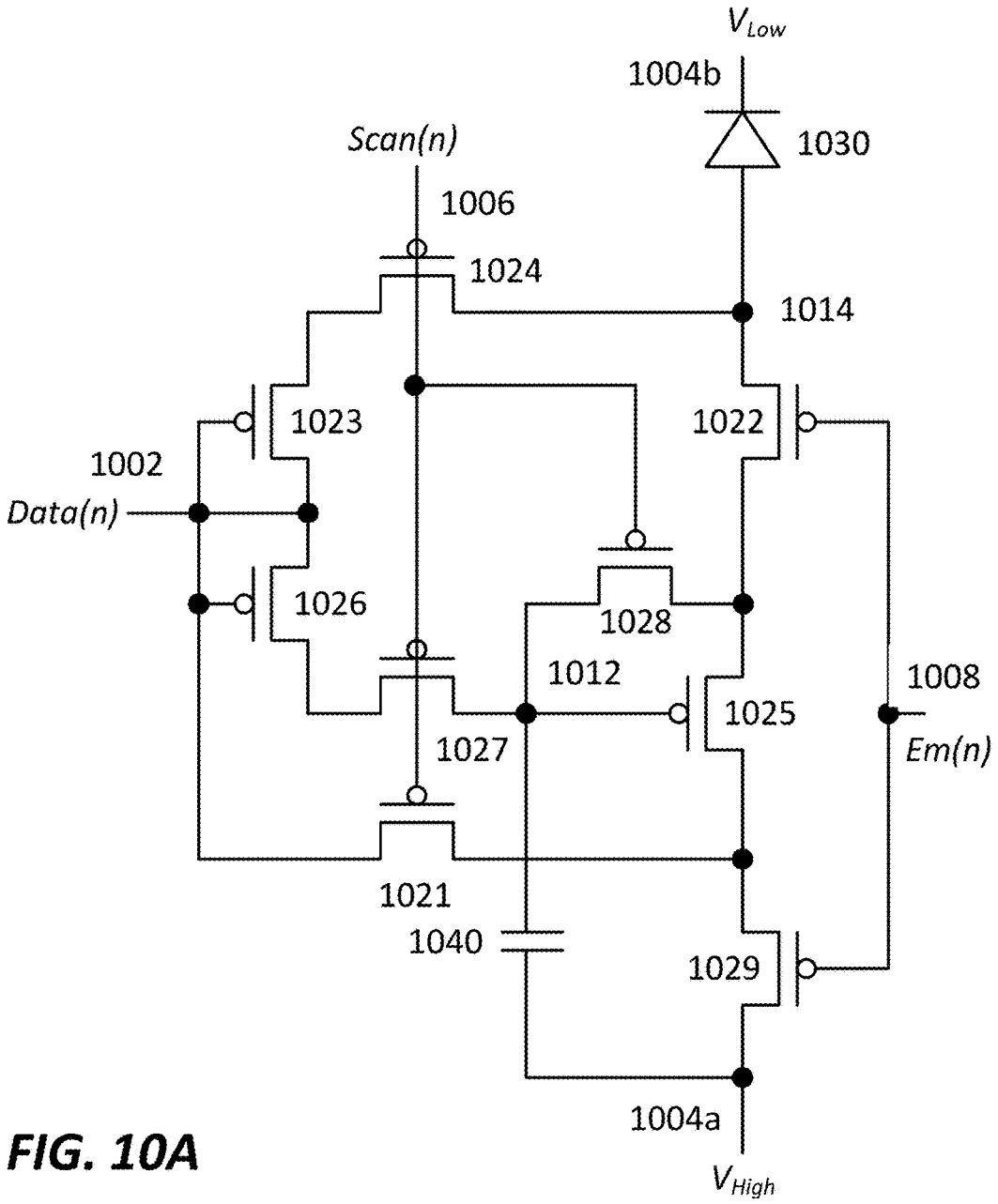
FIG. 10A schematically illustrates an alternative implementation of an example OLED circuit.

FIG. 10A schematically illustrates an alternative implementation of an example OLED circuit. The OLED circuit 1000 also includes nine total transistors, including two diode-connected transistors 1023 and 1026.

Figure 10B:
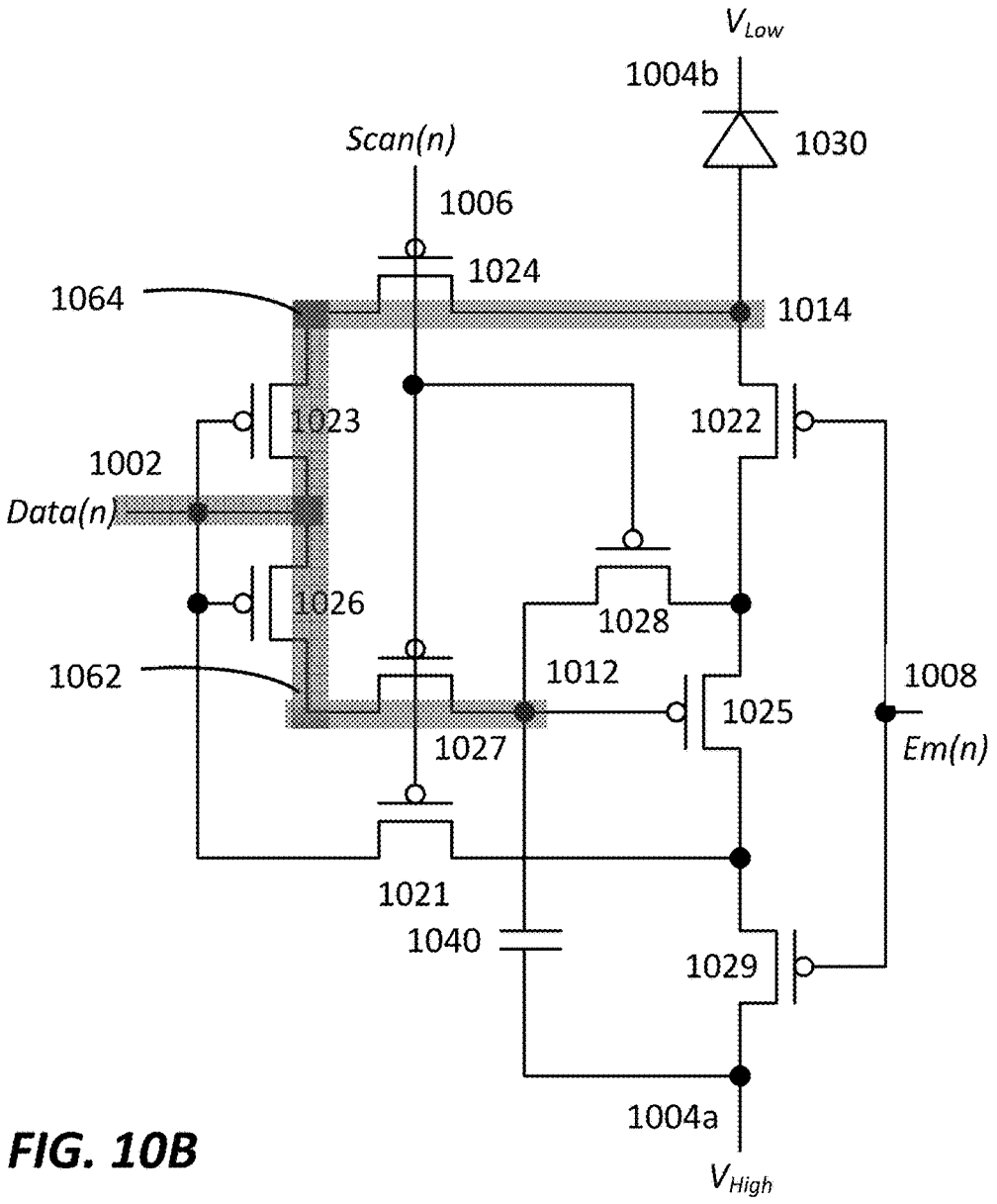
FIGS. 10B to 10D schematically illustrate the operation of the example OLED circuit of FIG. 10A.
Figure 10C:
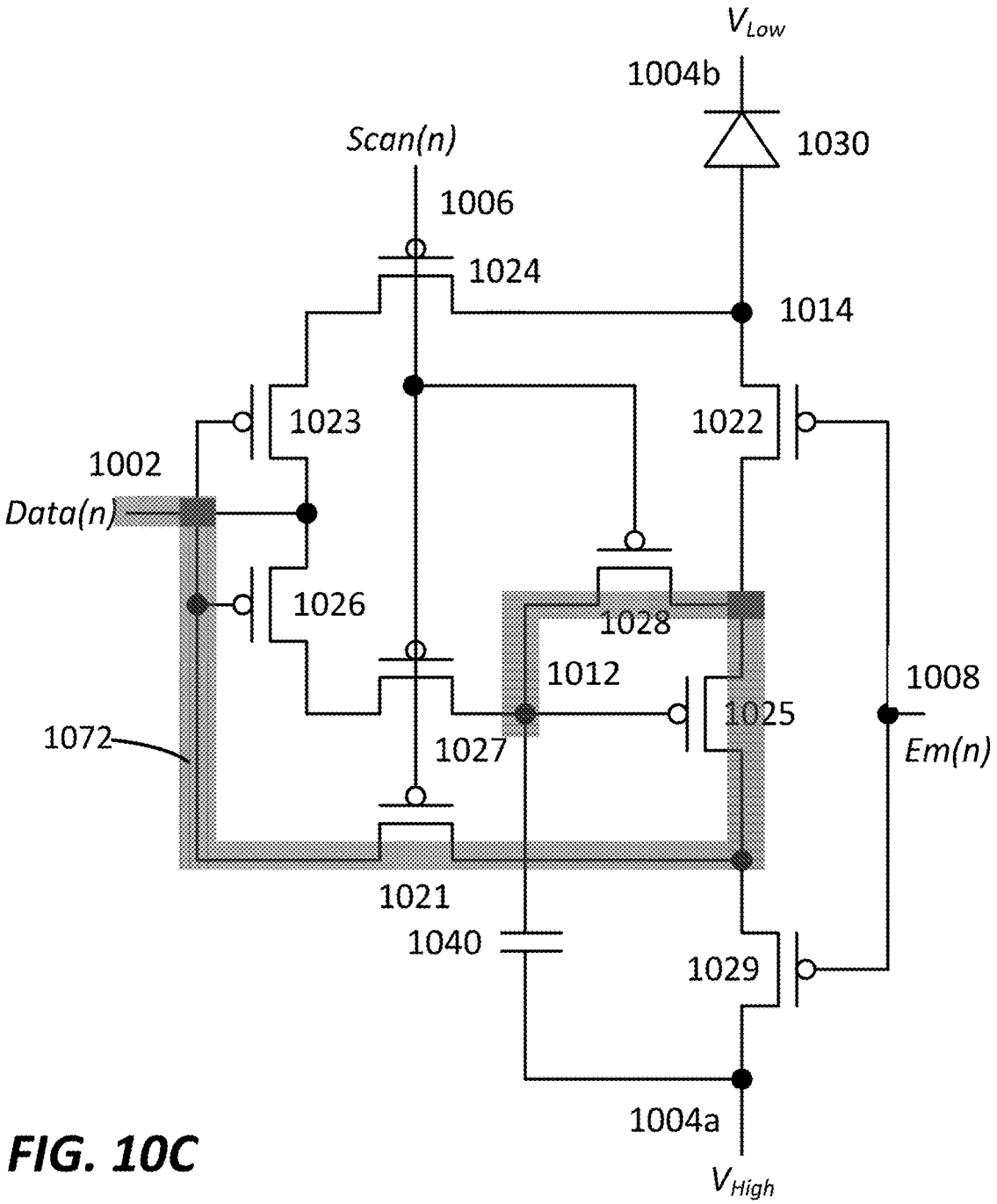
Figure 10D:
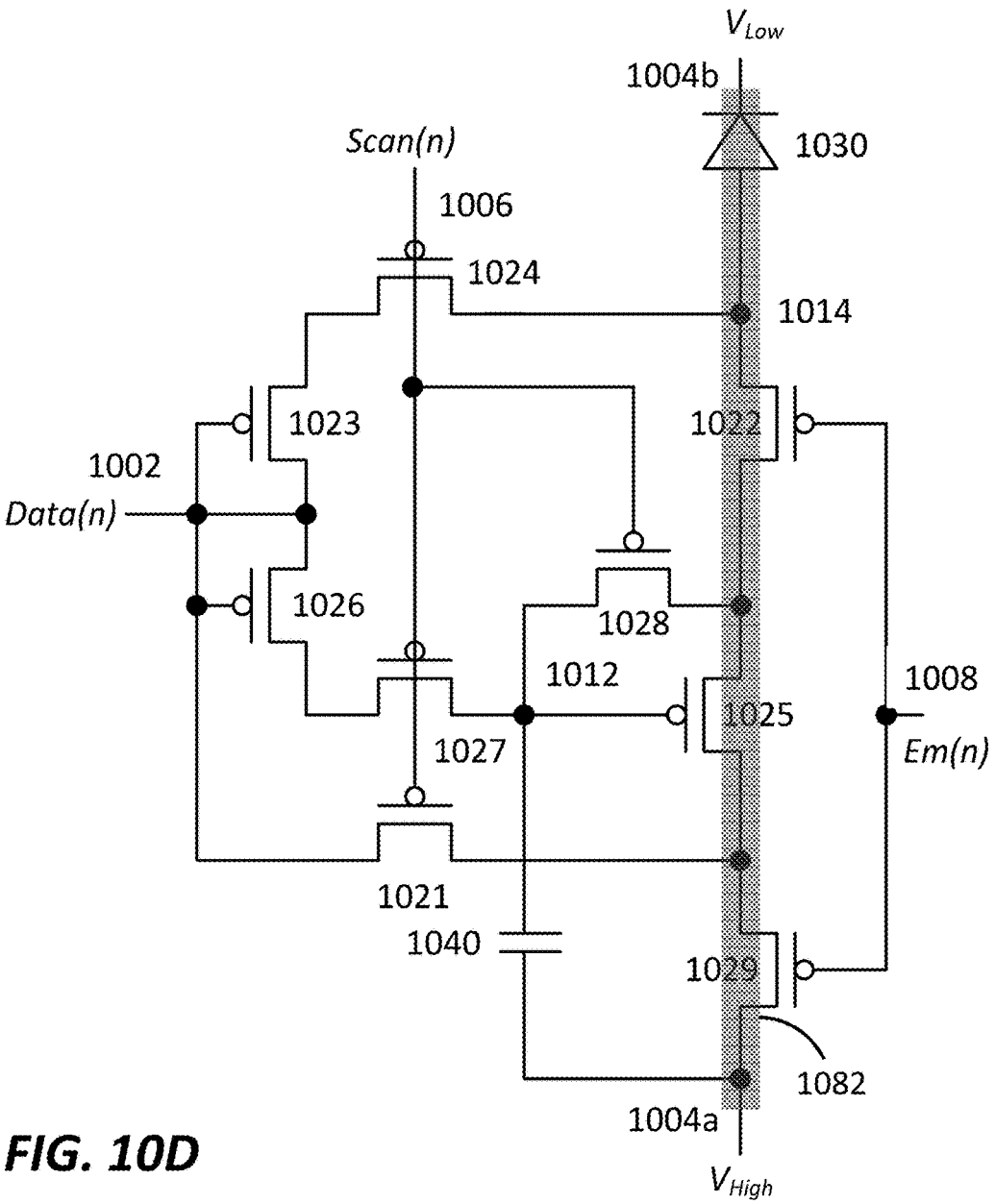

FIGS. 10B to 10D schematically illustrate the operation of the example OLED circuit of FIG. 10A. As can be seen in FIG. 10B, in the initialization phase, when a low scan voltage is applied on scan line 1006, a low data voltage is applied on data line 1002, and a high emission voltage is applied on the emission line, the voltage at location 1014 at the anode of the OLED 1030 may be discharged along discharge path 1064 through transistor 1024 and diode-connected transistor 1023, if the voltage is sufficiently high. Similarly, the voltage at location 1012 at the gate of driving transistor 1025 may be discharged along discharge path 1062 through transistor 1027 and diode-connected transistor 1026 if the voltage is sufficiently high.

As can be seen in FIG. 10C, in the programming phase, when a low scan voltage is applied on scan line 1006, a high data voltage is applied on data line 1002, and a high emission voltage is applied on the emission line, the voltage at the plate of the storage capacitor 1040 will be charged to a voltage ($V_{DataHigh}-|V_{Th5}|$). As the potential at the plate of storage capacitor 1040 is equal to the potential at location 1012 at the gate of driving transistor 1025, the driving transistor 1025 will be turned off once the potential reaches ($V_{DataHigh}-|V_{Th5}|$). This charging will occur along path 1072 passing from the data line 1002 through data switch transistor 1021, driving transistor 1025, and transistor 1028. Transistors 1024 and 1027 may serve a leak-suppression function in the OLED circuit 1000 due to possible leakage through diode-connected transistors 1023 and 1026.

As can be seen in FIG. 10D, in the emission phase, when a low emission voltage is applied on the emission line 1008 and a low data voltage is applied on the data line 1002, the OLED 1030 is energized by current flowing along path 1082 through power conduction transistor 1029, driving transistor 1025, and OLED-connected transistor 1022. Because the threshold voltage of driving transistor 1025 was stored on storage capacitor 1040 during the programming phase, the current through the OLED 1030 will be independent of the threshold voltage of the driving transistor 1025.

Figure 11A:
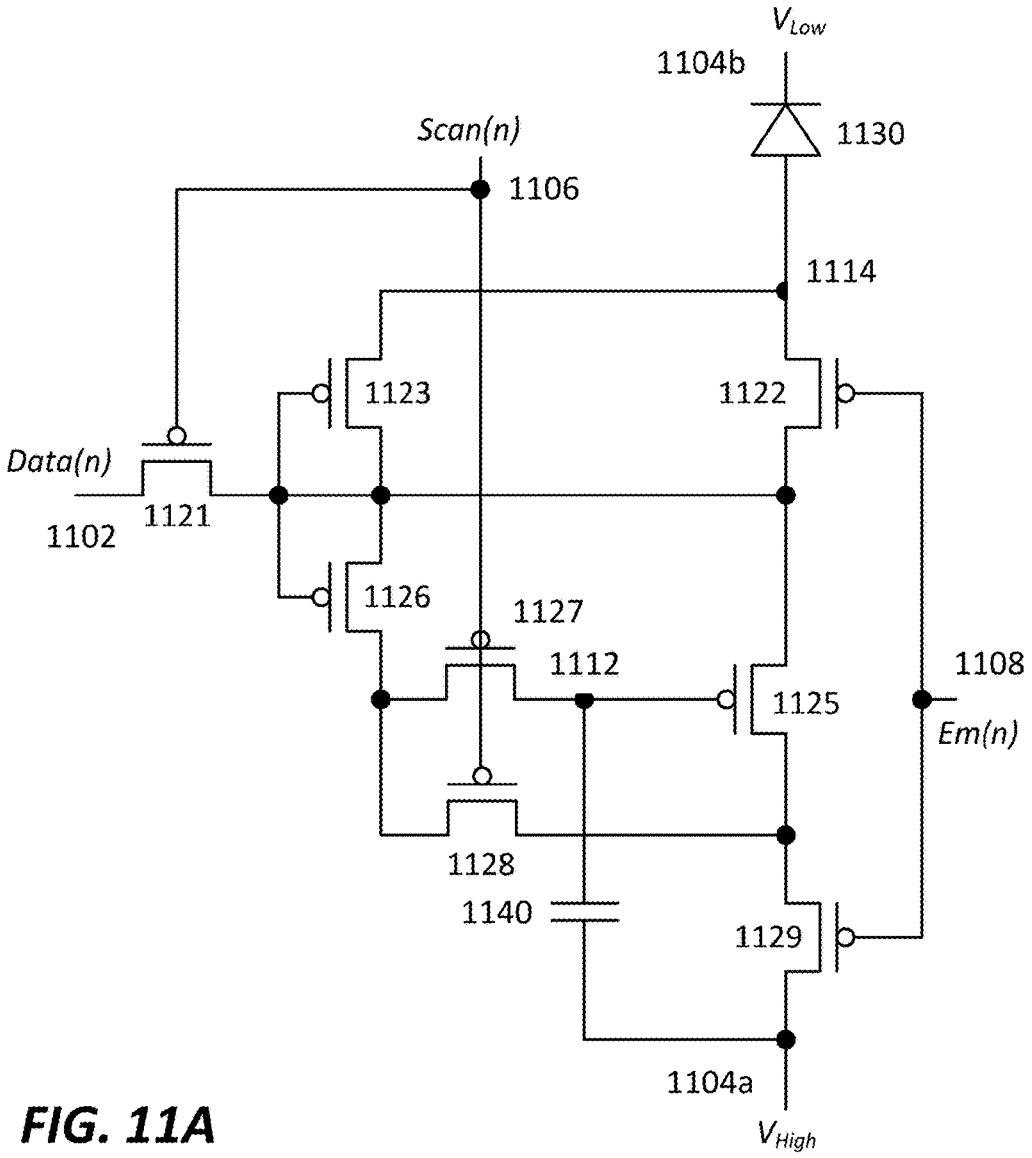
FIG. 11A schematically illustrates another alternative implementation of an example OLED circuit, which uses one fewer transistor than the implementation of FIG. 3.

FIG. 11A schematically illustrates an alternative implementation of an OLED circuit, which uses one fewer transistor than the implementation of FIG. 3. The OLED circuit 1100 includes eight transistors, including a driving transistor 1125, a power conduction transistor 1129, an OLED-connected transistor 1122, a data switch transistor 1121, and two diode-connected transistors 1123 and 1126. The OLED circuit 1100 is equivalent to the OLED circuit 900 of FIG. 9, without the inclusion of transistor 1124.

Figure 11B:
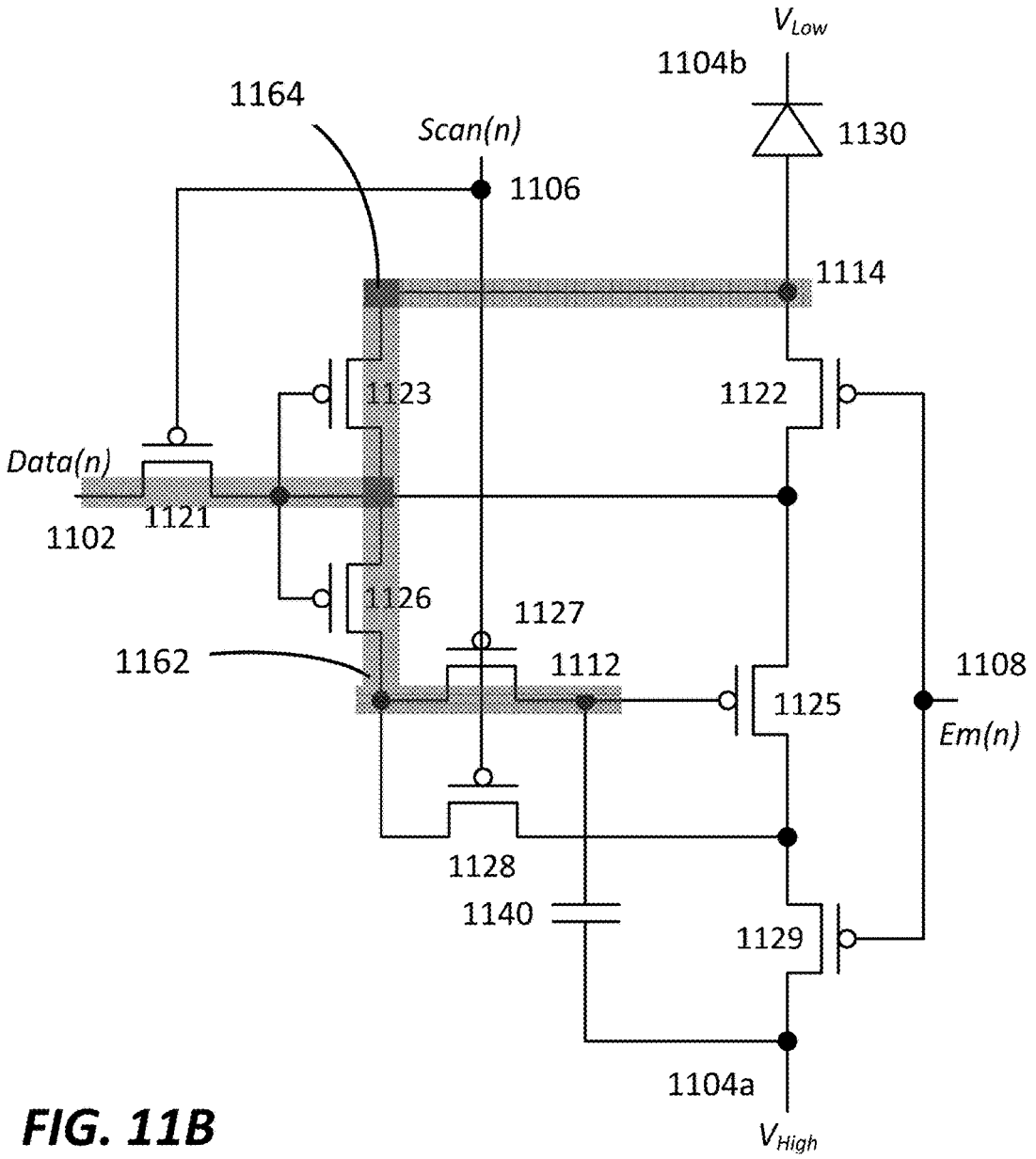
FIGS. 11B to 11D schematically illustrate the operation of the example OLED circuit of FIG. 11A.
Figure 11C:
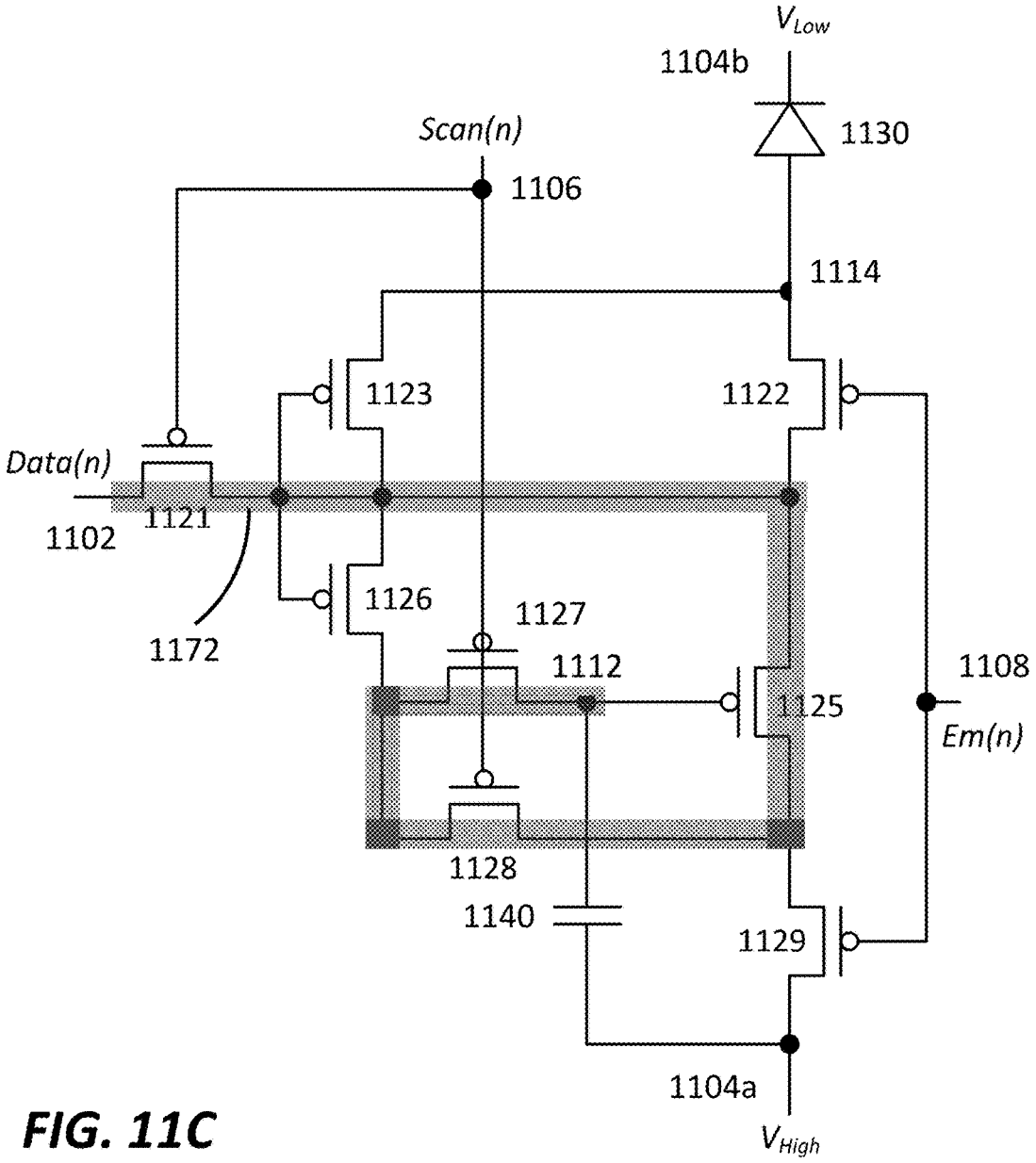
Figure 11D:
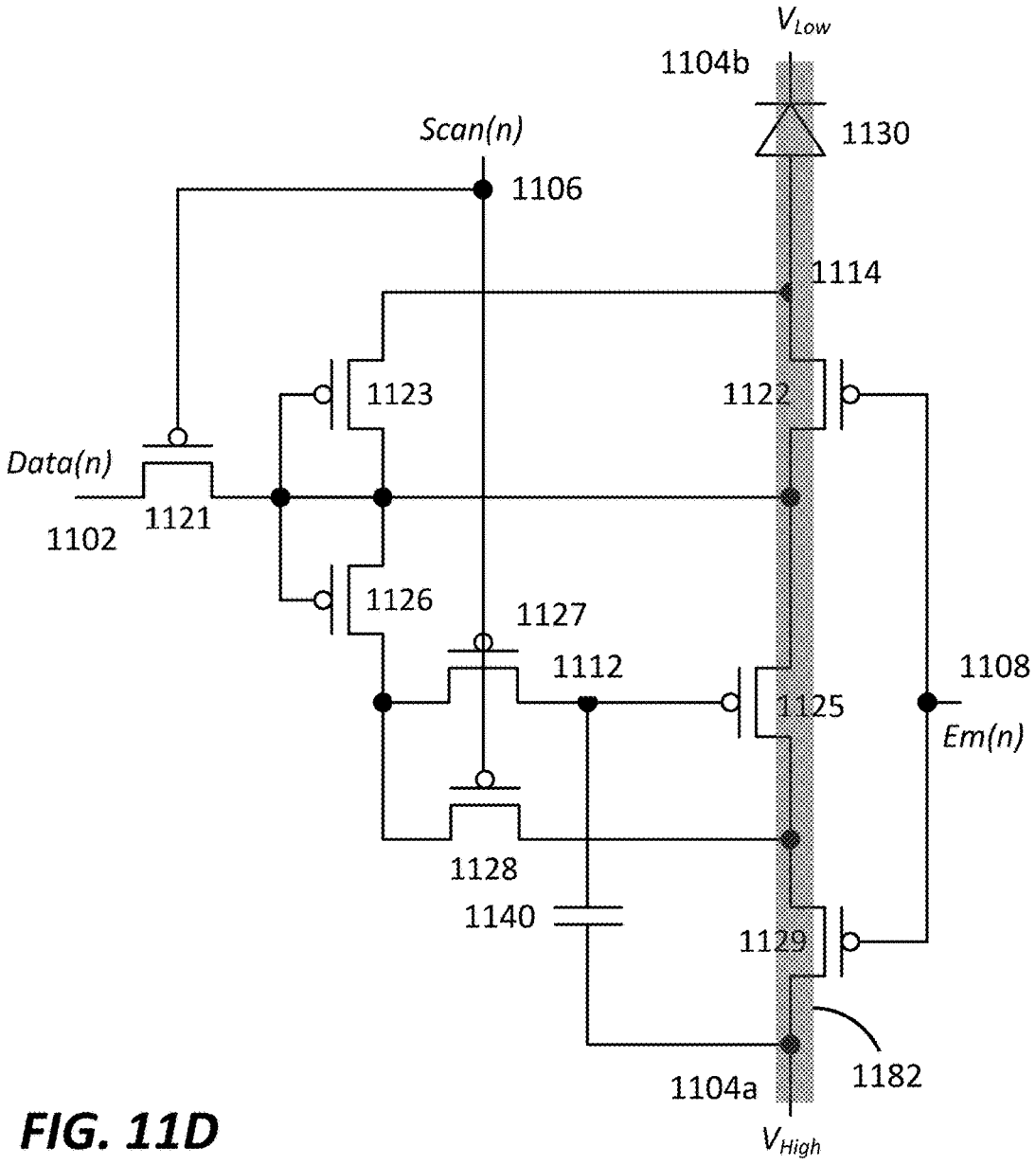

FIGS. 11B to 11D schematically illustrate the operation of the example OLED circuit of FIG. 11A. As can be seen in FIG. 11B, in the initialization phase, when a low scan voltage is applied on scan line 1106, a low data voltage is applied on data line 1102, and a high emission voltage is applied on the emission line, the voltage at location 1114 at the anode of the OLED 1130 may be discharged along discharge path 1162 through diode-connected transistor 1123 and data switch transistor 1121 if the voltage is sufficiently high. Similarly, the voltage at location 1112 at the plate of the storage capacitor 1140 may be discharged along discharge path 1162 through transistor 1127, diode-connected transistor 1126, and data switch transistor 1121 if the voltage is sufficiently high.

As can be seen in FIG. 11C, in the programming phase, when a low scan voltage is applied on scan line 1106, a high data voltage is applied on data line 1102, and a high emission voltage is applied on the emission line, the voltage at the plate of the storage capacitor 1140 will be charged to a voltage ($V_{DataHigh}-|V_{Th5}|$). As the location 1112 is at the same potential as the gate of driving transistor 1125, the driving transistor 1125 will be turned off once the potential reaches ($V_{DataHigh}-|V_{Th5}|$). This charging will occur along path 1172 passing from the data line 1102 through data switch transistor 1121, driving transistor 1125, and transistors 1127 and 1128. The leakage-suppressing transistor 1127 may suppress leakage through diode-connected transistor 1126, but no dedicated leakage-suppressing transistor is provided for diode-connected transistor 1123 in the OLED circuit 1100. Rather, leakage suppression can be provided through selection of the threshold voltage of the diode-connected transistor 1123.

As can be seen in FIG. 11D, in the emission phase, when a low emission voltage is applied on the emission line 1108 and a low data voltage is applied on the data line 1102, the OLED 1130 is energized by current flowing along path 1182 through power conduction transistor 1129, driving transistor 1125, and OLED-connected transistor 1122. In some implementations, because the threshold voltage of driving transistor 1125 was stored on storage capacitor 1140 during the programming phase, the current through the OLED 1130 will again be independent of the threshold voltage of the driving transistor 1125. The independence from the threshold voltage will result in more uniformity across an OLED display.

Figure 12A:
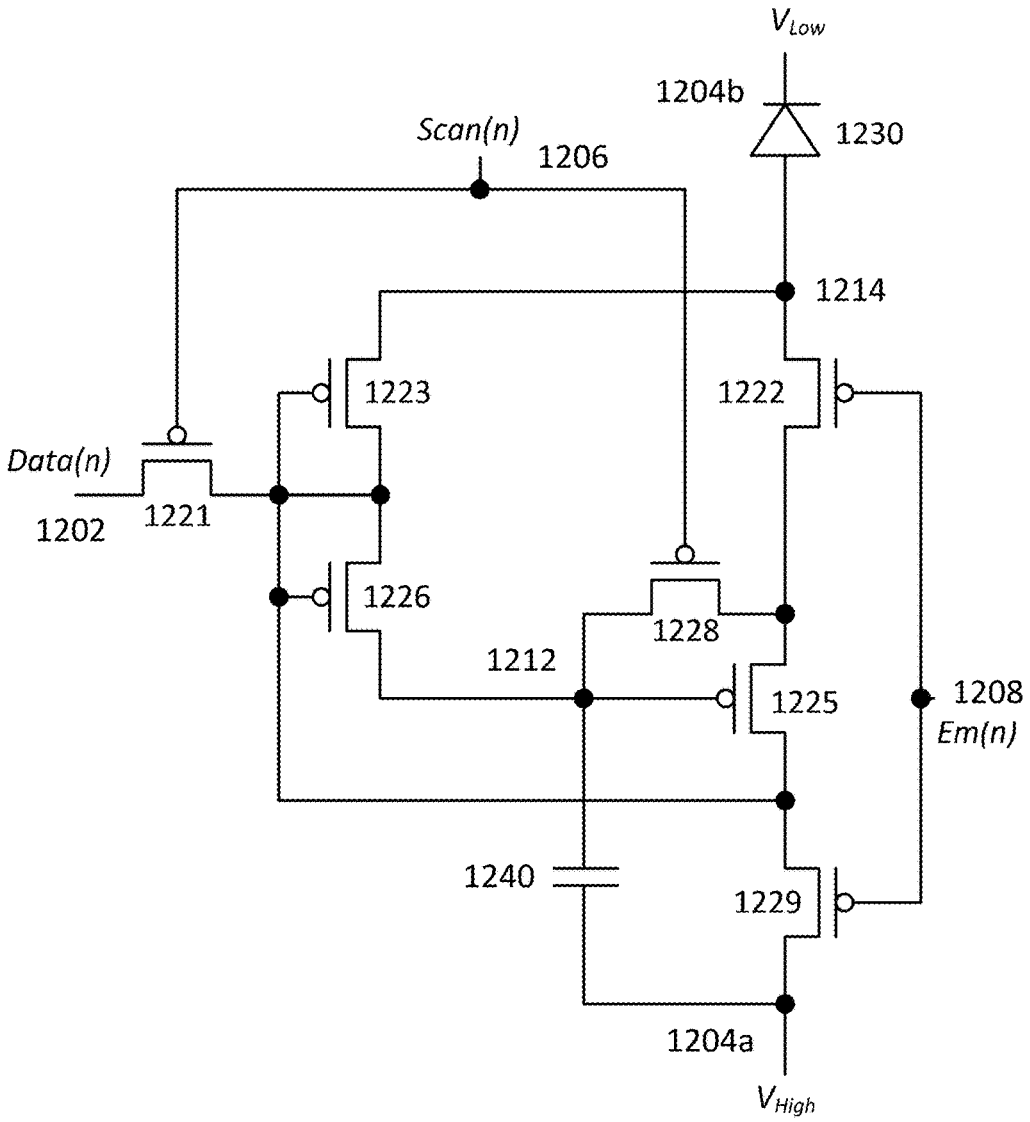
FIG. 12A schematically illustrates another alternative implementation of an example OLED circuit, which uses two fewer transistors than the implementation of FIG. 3.

FIG. 12A schematically illustrates an alternative implementation of an OLED circuit, which uses two fewer transistors than the implementation of FIG. 3. The OLED circuit 1200 includes seven transistors, including a driving transistor 1225, a power conduction transistor 1229, an OLED-connected transistor 1222, a data switch transistor 1221, and two diode-connected transistors 1223 and 1228. The OLED circuit 1200 is equivalent to the OLED circuit 800 of FIG. 8, without the inclusion of leak-suppressing transistors 824 and 827.

Figure 12B:
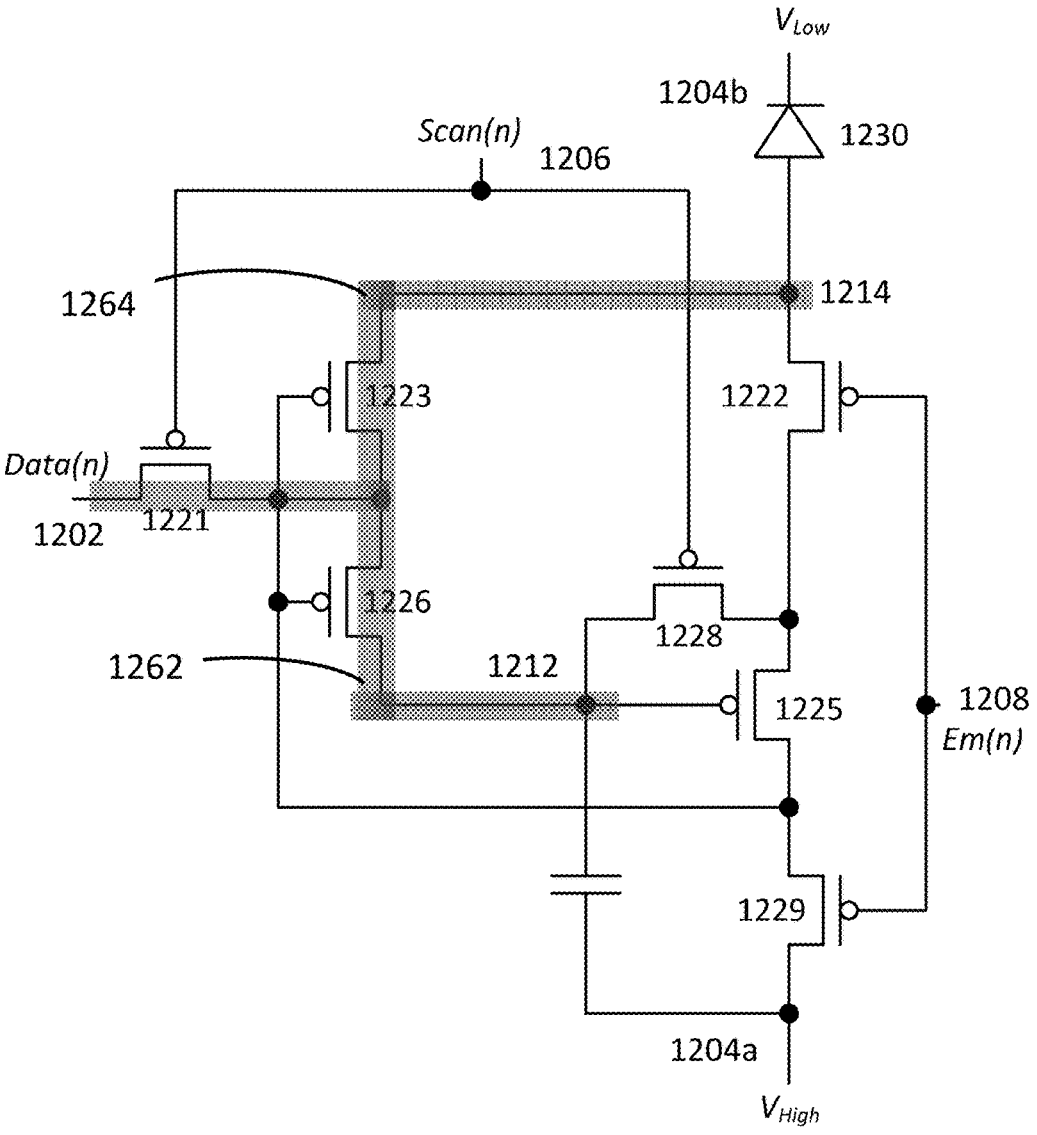
FIGS. 12B to 12D schematically illustrate the operation of the example OLED circuit of FIG. 12A.
Figure 12C:
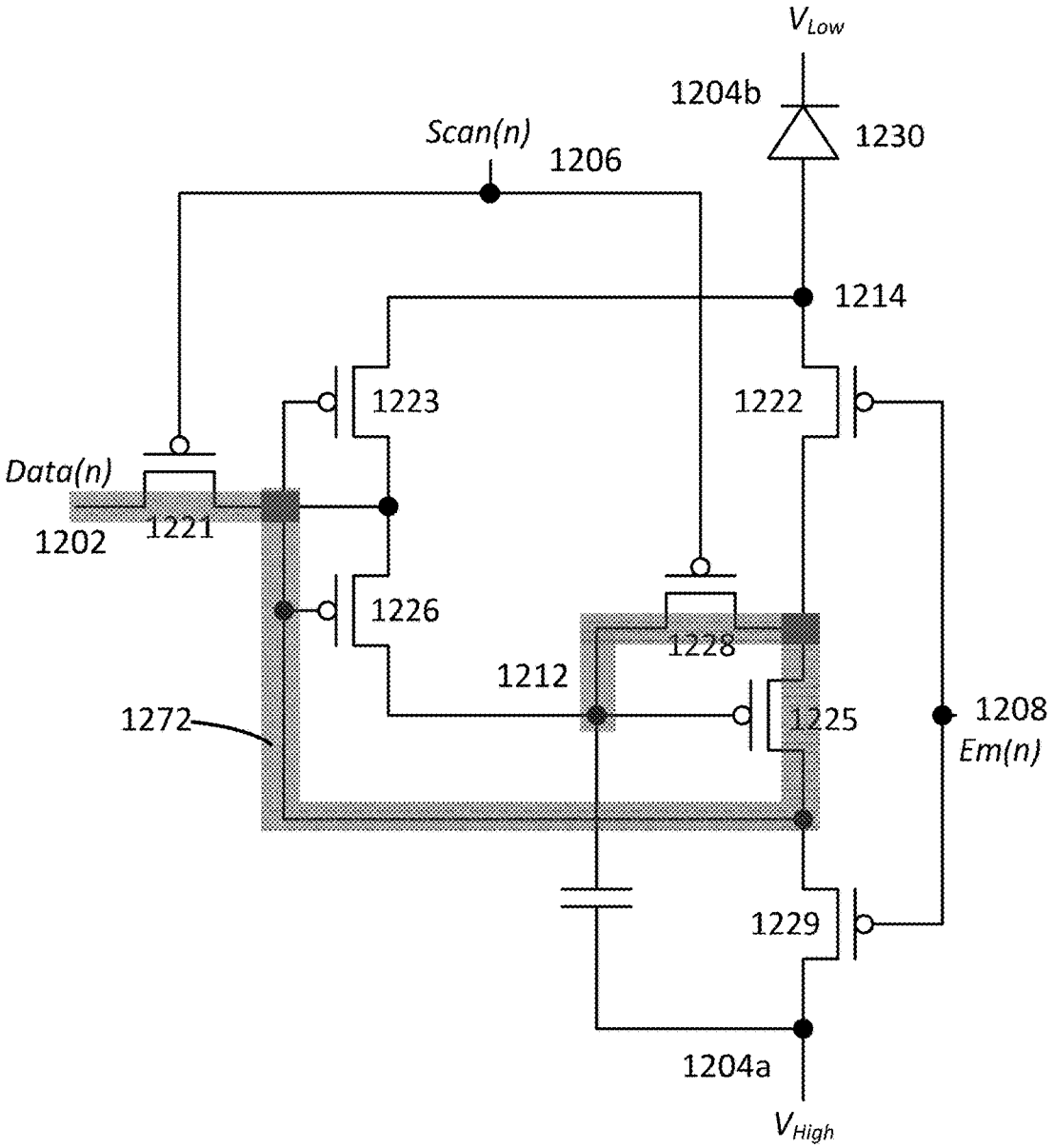
Figure 12D:
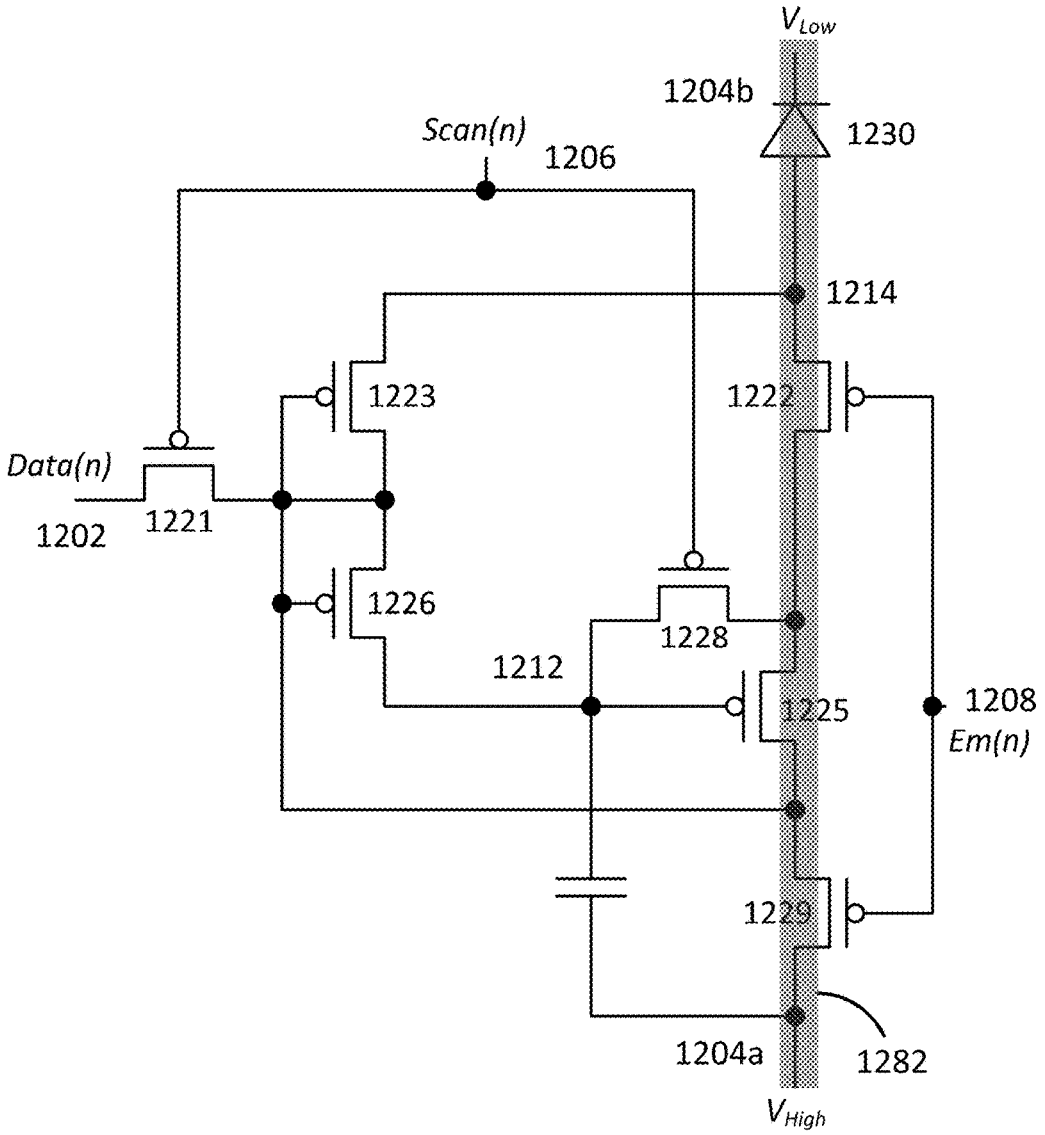

FIGS. 12B to 12D schematically illustrate the operation of the example OLED circuit of FIG. 12A. As can be seen in FIG. 12B, in the initialization phase, when a low scan voltage is applied on scan line 1206, a low data voltage is applied on data line 1202, and a high emission voltage is applied on the emission line 1208, the voltage at location 1214 at the anode of the OLED 1230 may be discharged along discharge path 1262 through diode-connected transistor 1223 and data switch transistor 1221 if the voltage is sufficiently high. Similarly, the voltage at location 1212 at the plate of the storage capacitor 1240 may be discharged along discharge path 1262 through diode-connected transistor 1226, and data switch transistor 1221 if the voltage is sufficiently high.

As can be seen in FIG. 12C, in the programming phase, when a low scan voltage is applied on scan line 1206, a high data voltage is applied on data line 1202, and a high emission voltage is applied on the emission line 1208, the voltage at the plate of the storage capacitor 1240 will be charged to a voltage ($V_{DataHigh}-|V_{Th5}|$). As the location 1212 is at the same potential as the gate of driving transistor 1225, the driving transistor 1225 will be turned off once the potential reaches ($V_{DataHigh}-|V_{Th5}|$). This charging will occur along path 1272 passing from the data line 1202 through data switch transistor 1221, driving transistor 1225, and transistor 1228. Unlike the other OLED circuits described herein, no dedicated leakage-suppressing transistor is provided for diode-connected transistors 1223 or 1226 in the OLED circuit 1100. Rather, leakage suppression can be provided through selection of the threshold voltage of the diode-connected transistor 1223 and 1226.

As can be seen in FIG. 12D, in the emission phase, when a low emission voltage is applied on the emission line 1208 and a low data voltage is applied on the data line 1202, the OLED 1230 is energized by current flowing along path 1282 through power conduction transistor 1229, driving transistor 1225, and OLED-connected transistor 1222. In some implementations, because the threshold voltage of driving transistor 1225 was stored on storage capacitor 1240 during the programming phase, the current through the OLED 1230 will again be independent of the threshold voltage of the driving transistor 1225, resulting in greater uniformity across an OLED display.

Although described herein with respect to OLED displays, the processes and structures described herein can be used in conjunction with other types of displays or any other appropriate display technology, including but not limited to display technologies which benefit from reversing the bias of the display elements.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described throughout. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, or, any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An organic light-emitting diode (OLED) control circuit configured to receive signals from a data line, an emission line, a scan line, a high-power supply line and a low power supply line, the OLED control circuit comprising:

an organic light-emitting diode (OLED) having an anode and a cathode, the cathode in electrical communication with the low power supply line;

a driving transistor having a gate, a source, and a drain, the source of the driving transistor in electrical communication with the OLED and a drain of the driving transistor in electrical communication with the high-power supply line;

a storage capacitor, a first plate of the storage capacitor in electrical communication with both the gate and the drain of the driving transistor, and a second plate of the storage capacitor in electrical communication with the high power supply line;

a data switch transistor having a source in electrical communication with the data line, a drain in electrical communication with the drain of the driving transistor, and a gate in electrical communication with the scan line; and a first diode-connected transistor, the first diode-connected transistor having a gate, a drain, and a source, the drain of the first diode-connected transistor connected to the gate of the first diode-connected transistor and in electrical communication with the data line, and the source of the first diode-connected transistor in electrical communication with the anode of the OLED.

2. The control circuit of claim 1, additionally comprising a second diode-connected transistor having a source, a gate, and a drain, the drain of the second diode-connected transistor connected to the gate of the first diode-connected transistor and in electrical communication with the data line, and the source of the second diode-connected transistor in electrical communication with the first plate of the storage capacitor.

3. The control circuit of claim 2, additionally comprising a first leak-suppressing transistor connected between the source of the first diode-connected transistor and the anode of the OLED.

4. The control circuit of claim 3, additionally comprising a second leak-suppressing transistor connected between the source of the first diode-connected transistor and the first plate of the storage capacitor.

5. The control circuit of claim 1, additionally comprising a power conducting transistor, the power conducting transistor connected between the source of the driving transistor and the high-power supply line, the power conducting transistor having a gate in electrical communication with the emission line, a source in electrical communication with the high-power supply line, and a drain in electrical communication with the source of the power conduction transistor.

6. The control circuit of claim 1, additionally comprising an OLED-connected transistor, the OLED-connected transistor connected between the data switching transistor and the anode of the OLED, the OLED-connected transistor having a gate in electrical communication with the emission line, a source in electrical communication with OLED, and a drain in electrical communication with the data switching transistor.

7. The control circuit of claim 1, wherein the control circuit is configured to initialize the OLED by draining voltage from the anode of the OLED through the first diode-connected transistor to reverse the bias of the OLED.

8. The control circuit of claim 1, wherein the first plate of the storage capacitor is configured to store a reference voltage, and wherein the reference voltage is a function of a high data voltage applied on the on the data line and the threshold voltage of the driving transistor.

9. An organic light-emitting diode (OLED) control circuit configured to receive signals from a data line, an emission line, a scan line, a high-power supply line and a low power supply line, the OLED control circuit comprising:

an organic light-emitting diode (OLED) having an anode and a cathode, the cathode in electrical communication with the low power supply line;

a driving transistor having a gate, a source, and a drain, the source of the driving transistor in electrical communication with the OLED and a drain of the driving transistor in electrical communication with the high-power supply line;

means for storing a reference voltage, the reference voltage being a function of a high data voltage applied on the on the data line and the threshold voltage of the driving transistor;

a data switch transistor having a source in electrical communication with the data line, a drain in electrical communication with the drain of the driving transistor, and a gate in electrical communication with the scan line; and a first diode-connected transistor configured to drain voltage from the anode of the OLED through the initializing means to reverse the bias of the OLED, the first diode-connected transistor having a gate, a drain, and a source, the drain of the first diode-connected transistor connected to the gate of the first diode-connected transistor and in electrical communication with the data line, and the source of the first diode-connected transistor in electrical communication with the anode of the OLED.

10. The control circuit of claim 9, wherein the storage means comprises a storage capacitor, a first plate of the storage capacitor in electrical communication with both the gate and the drain of the driving transistor, and a second plate of the storage capacitor in electrical communication with the high power supply line.

11. The control circuit of claim 9, additionally comprising a second diode-connected transistor having a source, a gate, and a drain, the drain of the second diode-connected transistor connected to the gate of the first diode-connected transistor and in electrical communication with the data line, and the source of the second diode-connected transistor in electrical communication with the first plate of the storage capacitor.

12. The control circuit of claim 11, additionally comprising a first leak-suppressing transistor connected between the source of the first diode-connected transistor and the anode of the OLED.

13. The control circuit of claim 12, additionally comprising a second leak-suppressing transistor connected between the source of the first diode-connected transistor and the first plate of the storage capacitor.

14. The control circuit of claim 9, additionally comprising a power conducting transistor, the power conducting transistor connected between the source of the driving transistor and the high-power supply line, the power conducting transistor having a gate in electrical communication with the emission line, a source in electrical communication with the high-power supply line, and a drain in electrical communication with the source of the power conduction transistor.

15. The control circuit of claim 9, additionally comprising an OLED-connected transistor, the OLED-connected transistor connected between the data switching transistor and the anode of the OLED, the OLED-connected transistor having a gate in electrical communication with the emission line, a source in electrical communication with OLED, and a drain in electrical communication with the data switching transistor.

16. A method of controlling an organic light-emitting diode (OLED) circuit in electrical communication with a data line, an emission line, a scan line, a high-power supply line and a low power supply line, comprising:

initializing the OLED circuit by applying a low voltage signal on the data line, and placing an anode of an OLED in electrical communication with the low voltage signal via a diode-connected transistor;

programming the OLED by applying a high voltage signal on the data line, and storing a reference voltage on a plate of a storage capacitor by charging the plate of the storage capacitor through a driving transistor of the OLED circuit, the reference voltage being a function of the high voltage signal applied on the data line and a threshold voltage of the driving transistor of the OLED circuit; and energizing the OLED by applying a current through the OLED.

17. The method of claim 16, wherein the initializing the OLED circuit reverses the bias of the OLED.

18. The method of claim 16, wherein energizing the OLED comprises applying a current through the OLED which is independent of the threshold voltage of the driving transistor.

19. The method of claim 16, additionally comprising applying an emission signal on the emission line and simultaneously applying a scan signal on the scan line, wherein the emission signal is generated by driver circuitry in electrical communication with the OLED circuit, and wherein the scan signal is generated by the same driver circuitry.

* * * * *